US009125503B2

(12) United States Patent
Hawkins

(10) Patent No.: US 9,125,503 B2
(45) Date of Patent: Sep. 8, 2015

(54) FREE-STANDING DISPLAY FIXTURE

(71) Applicant: Target Brands, Inc., Minneapolis, MN (US)

(72) Inventor: Laura L. Hawkins, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/568,851

(22) Filed: Dec. 12, 2014

(65) Prior Publication Data

US 2015/0096951 A1 Apr. 9, 2015

Related U.S. Application Data

(62) Division of application No. 13/826,558, filed on Mar. 14, 2013, now Pat. No. 8,944,260.

(60) Provisional application No. 61/766,435, filed on Feb. 19, 2013.

(51) Int. Cl.
*A47F 1/04* (2006.01)
*A47F 5/00* (2006.01)
(Continued)

(52) U.S. Cl.
CPC ..... *A47F 5/118* (2013.01); *A47B 43/02* (2013.01); *A47B 47/06* (2013.01); *A47B 55/06* (2013.01);
(Continued)

(58) Field of Classification Search
CPC ..... A47F 5/118; A47F 5/0025; A47F 5/0006; A47F 5/116; A47F 5/10; A47F 5/12; A47F 5/0087; A47F 5/0876; A47F 5/0018; A47F 1/125; A47F 5/11; A47F 5/0807; A47F 5/0815; A47F 5/112; A47F 5/0823; A47F 2005/0075; A47F 2005/165; A47F 5/083; A47F 5/0884; A47F 5/114; A47F 7/0028; A47F 7/0035; A47F 7/146; A47F 3/06; A47F 5/16; A47F 5/0081; A47B 57/04; A47B 55/06; A47B 43/02; A47B 47/06; A47B 43/00; A47B 47/00; A47B 96/00; A47B 96/021; A47B 96/02; G09F 5/042
USPC ..... 211/150, 190, 187, 149, 59.2, 59.1, 72, 211/73, 135, 57.1; 248/152, 174, 300; 206/45.25, 175, 176, 193, 395, 362.4, 206/784, 750, 525.1
See application file for complete search history.

(56) References Cited

U.S. PATENT DOCUMENTS 1,716,964 A 6/1929 Kuck
1,929,768 A 10/1933 Bixby
(Continued)

OTHER PUBLICATIONS

Bizrice, "Cardboard Free Standing Point of Sale Leaflet Displays," http://sell.bizrice.com/selling-leads/1004428/Cardboard-Free-standing-point-of-sale-leaflet-displays.html, 1 page, at least as early as Jan. 2013.
(Continued)

*Primary Examiner* — Jennifer E Novosad
(74) *Attorney, Agent, or Firm* — Leanne Taveggia Farrell; Westman, Champlin & Koehler, P.A.

(57) ABSTRACT

A free-standing display fixture includes a main body having a top edge, a bottom edge, a right side panel, a center panel and a left side panel. Each of the left side panel, the center panel and the right side panel include interior surfaces and the interior surfaces of the left side panel and the right side panel face each other. Located between and coupled to left side panel and right panel are a plurality of uniquely arranged display components.

19 Claims, 33 Drawing Sheets

(51) Int. Cl.

| | |
|---|---|
| ***A47F 7/00*** | (2006.01) |
| ***A47B 47/06*** | (2006.01) |
| ***A47B 43/02*** | (2006.01) |
| ***A47F 5/11*** | (2006.01) |
| ***A47B 55/06*** | (2006.01) |
| ***A47F 5/08*** | (2006.01) |
| *A47F 5/16* | (2006.01) |

(52) U.S. Cl.

CPC ..... *A47F 5/0006* (2013.01); *A47F 5/0018* (2013.01); *A47F 5/0025* (2013.01); *A47F 5/0815* (2013.01); *A47F 5/0823* (2013.01); *A47F 5/11* (2013.01); *A47F 5/116* (2013.01); *A47F 5/0876* (2013.01); *A47F 2005/165* (2013.01)

(56) References Cited

U.S. PATENT DOCUMENTS

| | | | | | |
|---|---|---|---|---|---|
| 2,802,576 | A | * | 8/1957 | Kelling | 211/59.1 |
| 3,570,679 | A | | 3/1971 | Edson | |
| 3,830,375 | A | | 8/1974 | Larson | |
| 3,856,146 | A | * | 12/1974 | Levine | 211/134 |
| 3,863,575 | A | | 2/1975 | Kuns et al. | |
| 4,331,245 | A | | 5/1982 | Schell | |
| 4,433,880 | A | | 2/1984 | Maravelas, Jr. et al. | |
| 4,508,231 | A | | 4/1985 | Honickman | |
| 4,570,805 | A | | 2/1986 | Smith | |
| 4,688,681 | A | | 8/1987 | Bergeron | |
| 4,705,175 | A | * | 11/1987 | Howard et al. | 211/59.2 |
| 4,733,782 | A | * | 3/1988 | Spezial et al. | 211/57.1 |
| 4,925,038 | A | * | 5/1990 | Gajewski | 211/59.2 |
| 4,978,013 | A | * | 12/1990 | Hogg | 211/133.2 |
| D320,896 | S | | 10/1991 | Prevedello et al. | |
| D328,398 | S | * | 8/1992 | Benedetto | D6/436 |
| 5,273,169 | A | | 12/1993 | Maglione | |
| 5,351,839 | A | * | 10/1994 | Beeler et al. | 211/59.3 |
| 5,392,902 | A | * | 2/1995 | Vlastakis | 211/135 |
| 5,427,255 | A | | 6/1995 | Nook | |
| 5,439,123 | A | | 8/1995 | Nook | |
| 5,465,851 | A | * | 11/1995 | Smith | 211/59.1 |
| 5,553,724 | A | | 9/1996 | Moher et al. | |
| 5,678,492 | A | | 10/1997 | Pinkstone et al. | |
| 5,702,011 | A | | 12/1997 | Carroll | |
| 5,749,480 | A | | 5/1998 | Wood | |
| 5,762,207 | A | * | 6/1998 | Maglione | 211/59.1 |
| 5,868,371 | A | | 2/1999 | Nuzzo | |
| 5,897,005 | A | | 4/1999 | Bernens et al. | |
| 5,899,345 | A | | 5/1999 | Fuller et al. | |
| 5,984,117 | A | | 11/1999 | Smith | |
| 5,988,476 | A | | 11/1999 | Olerio | |
| 6,053,460 | A | | 4/2000 | Wilkinson, Jr. et al. | |
| 6,068,140 | A | * | 5/2000 | Mangrum et al. | 211/132.1 |
| 6,530,490 | B1 | | 3/2003 | Kosann et al. | |
| 6,758,352 | B2 | | 7/2004 | Gervasi | |
| 6,929,133 | B1 | | 8/2005 | Knapp, III et al. | |
| 7,111,743 | B1 | * | 9/2006 | Moss et al. | 211/72 |
| 7,131,543 | B2 | | 11/2006 | Mason | |
| 7,175,034 | B2 | | 2/2007 | Nook et al. | |
| 7,252,200 | B1 | | 8/2007 | Hester | |
| 7,350,649 | B1 | | 4/2008 | Martens | |
| 7,500,574 | B1 | | 3/2009 | Miller, III et al. | |
| 7,900,784 | B1 | | 3/2011 | Weigand et al. | |
| 7,950,538 | B2 | | 5/2011 | Zang et al. | |
| 7,987,998 | B1 | | 8/2011 | Belk et al. | |
| D655,947 | S | | 3/2012 | Doane | |
| 8,172,093 | B1 | | 5/2012 | Belk et al. | |
| 8,281,943 | B2 | * | 10/2012 | Suman et al. | 211/150 |
| 8,944,260 | B2 | * | 2/2015 | Hawkins | 211/72 |
| 2005/0173359 | A1 | * | 8/2005 | Wagner et al. | 211/90.02 |
| 2007/0272639 | A1 | | 11/2007 | Alexander | |
| 2010/0078401 | A1 | | 4/2010 | Vulpitta | |
| 2011/0068071 | A1 | | 3/2011 | Suman et al. | |
| 2012/0205330 | A1 | | 8/2012 | Belk et al. | |

OTHER PUBLICATIONS

Charapak, "Shelves & Tiers," http://www.charapak.co.uk/display/shelves-tiers.php, 1 page, at least as early as Jan. 2013.

Grand Fly,"FDS-065 Corrugated Free Standing Display Unit for Book," http://www.grandfly.com/Floor_Displays/FDS_065_Corrugated_Free_Standing_Display_Unit_for_Book.html, 1 page, at least as early as Jun. 2012.

McGowans Print, "Johnsons FSDU," http://www.mcgowansprint.com/products/retail/display-units/free-standing-display-units-fsdu/#jp-carousel-469, 1 page, at least as early as Jan. 2013.

Pyramid Visuals Blog, "free-standing-display-unit," http://blog.pyramidvisuals.co.uk/pos/cardboard-engineering/attachment/free-standing-display-unit, 1page, at least as early as Aug. 2010.

Office Action from Canadian Patent Application No. 2,813,615, mailed Aug. 29, 2013, 2 pages.

Office Action from Canadian Patent Application No. 2,813,615, mailed Jan. 9, 2014, 2 pages.

* cited by examiner

FREE-STANDING DISPLAY FIXTURE

CROSS-REFERENCE TO RELATED APPLICATION

The present application is a divisional of and claims priority to U.S. patent application Ser. No. 13/826,558, filed Mar. 14, 2013, which is based on and claims the benefit of U.S. provisional patent application Ser. No. 61/766,435, filed Feb. 19, 2013, the contents of which are hereby incorporated by reference in their entirety.

BACKGROUND

In retail stores, seasonal merchandise is often displayed on free-standing, temporary display fixtures. On these temporary display fixtures, seasonal merchandise must be easily accessible and visually pleasing to attract consumer traffic.

The discussion above is merely provided for general background information and is not intended to be used as an aid in determining the scope of the claimed subject matter.

SUMMARY

A display fixture includes a main body having a top edge, a bottom edge, a pair of side panels and at least one center panel. Each of the side panels and center panel include interior surfaces and the interior surfaces of the side panels face each other. A plurality of shelf trays are located between and are coupled to the side panels of the main body and include at least one upper shelf tray and at least one lower shelf tray. The at least one upper shelf tray includes a floor oriented substantially parallel with the top edge and the bottom edge of the main body and the at least one lower shelf tray includes a floor oriented at an angle relative to the bottom edge of the main body. The angle is an acute angle.

An alternative embodiment of the display fixture includes a center component having a front surface and back surfaces. Portions of the back surfaces of the center component are coupled to and abut the interior surface of the center panel of the main body. This alternative embodiment of the display fixture includes a plurality of shoulder bars extending between the left side panel of the main body and the right side panel of the main body. Each shoulder bar includes a first fixed end coupled to the left side panel and a second fixed end coupled to the right side panel. This alternative embodiment of the display fixture also includes a plurality of face out bars extending outwardly from and supported by the center body. Each face out bar includes a fixed end coupled to the center body and a free end. The plurality of face out bars are oriented substantially normal to the plurality of shoulder bars.

A further alternative embodiment of the display fixture includes a lower shelf located between and coupled to the left side panel and the right side panel of the main body. The lower shelf includes at least one divider for dividing the lower shelf into bins. This further alternative embodiment of the display fixture also includes an upper shelf located between the left side panel and the right side and supported by and coupled to the lower shelf. The upper shelf includes at least one divider for dividing the upper shelf into bins. A peg insert supports a plurality of peg hooks and is coupled to the interior surface of the center panel of the main body. The peg insert is located above the upper and lower shelves.

A further alternative embodiment of the display fixture includes a plurality of shelf trays located between and coupled to the side panels of the main body and including at least one upper shelf tray and at least one lower shelf tray. Each of the at least one upper shelf tray and the at least one lower shelf tray includes a floor oriented at an angle relative to the top edge and the bottom edge of the main body. The angle is an acute angle such that the backs of the at least one upper shelf tray and the at least one lower shelf tray are closer to the top edge of the main body than the fronts of the at least one upper shelf tray and the at least one lower shelf tray are to the top edge of the main body.

A further alternative embodiment of the display fixture includes a lower shelf positioned between and coupled to two sections of the main body that face each other, an upper shelf located above the lower shelf and positioned between and coupled to the two sections of the main body that face each other, and a cross-bar component coupled to and extending between the two sections of the main body that face each other. The cross-bar component includes spaced apart holes for receiving hooks of clothes hangers. The cross-bar component is spaced apart from the interior surface of the section of the main body that faces forward by a distance that is less than a length of a shoulder of a clothes hanger.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The display fixtures described below can be located in a retail store for displaying seasonal merchandise. Each display fixture includes a free-standing main body, a header that is mounted to a top edge of a center panel of the main body and a plurality of display components for displaying product. The header supports a sign holder for receiving a sign or graphic. The type of display components included in each display fixture and how these display components are arranged is based on, but not limited to, the type of product or products that are to be displayed.

Figure 1:
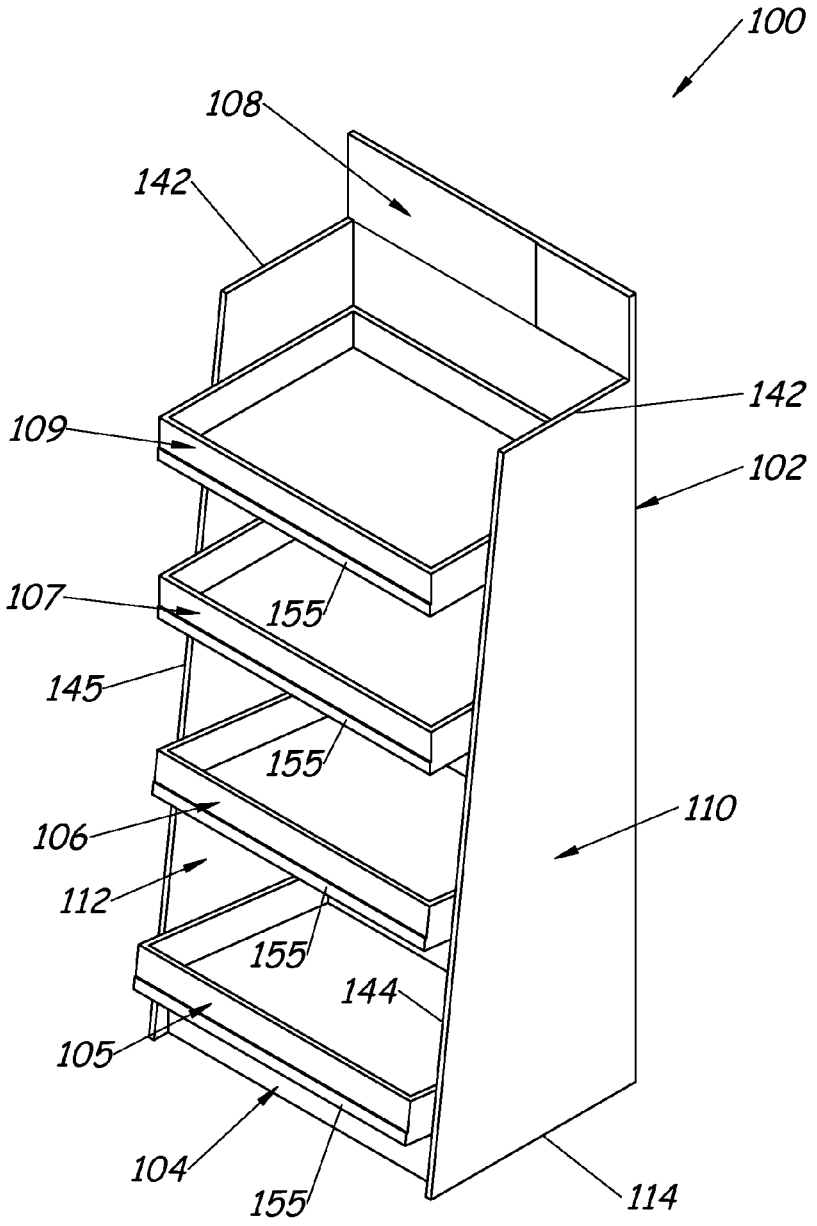
FIG. 1 is a perspective view of a display fixture according to one embodiment.
Figure 2:
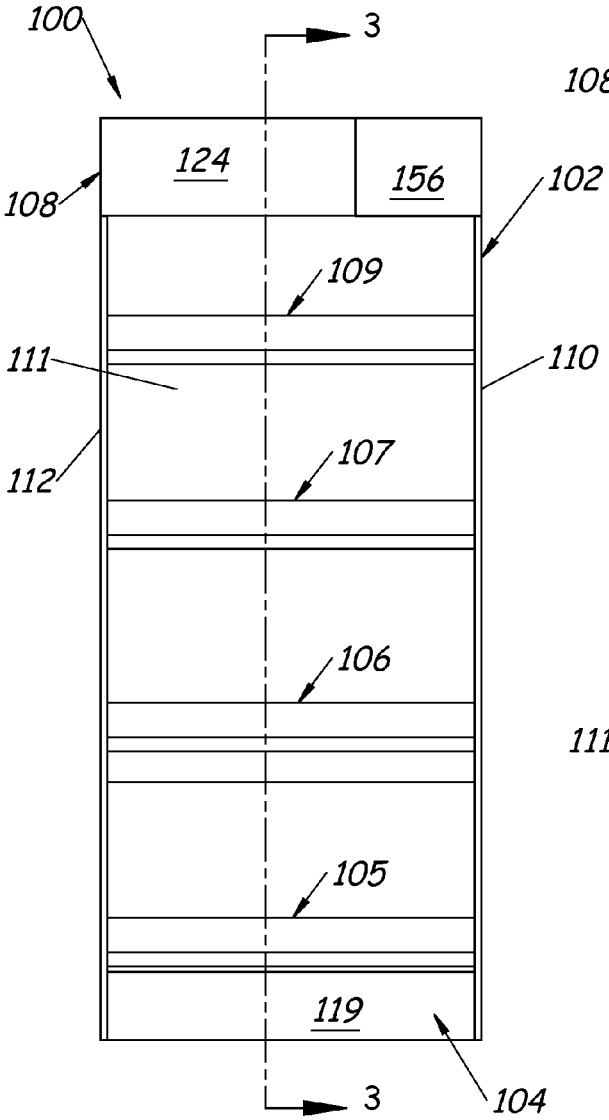
FIG. 2 is a front view of the display fixture illustrated in FIG. 1.
Figure 3:
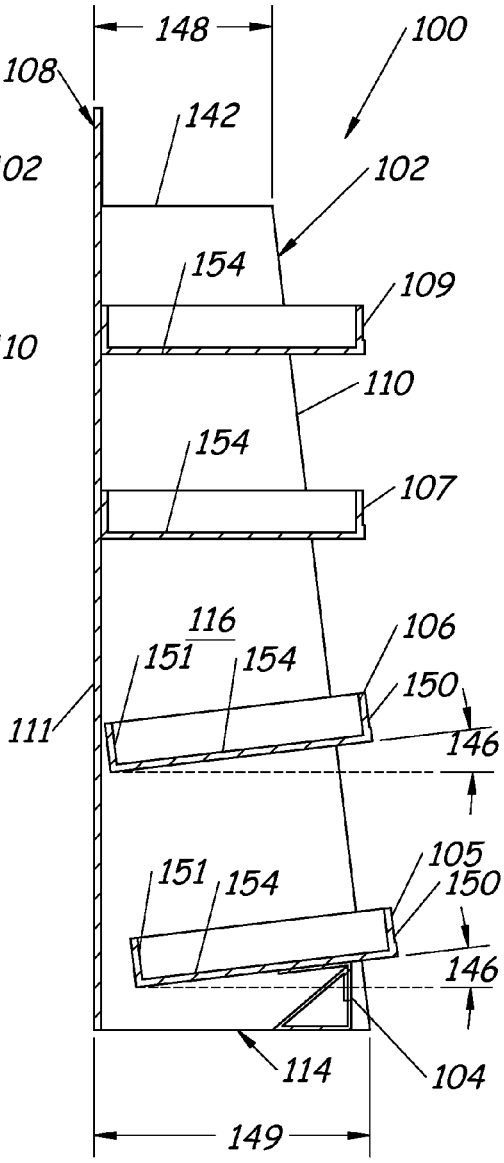
FIG. 3 is a section view of the display fixture illustrated in FIG. 1 taken along the line indicated in FIG. 2.
Figure 4:
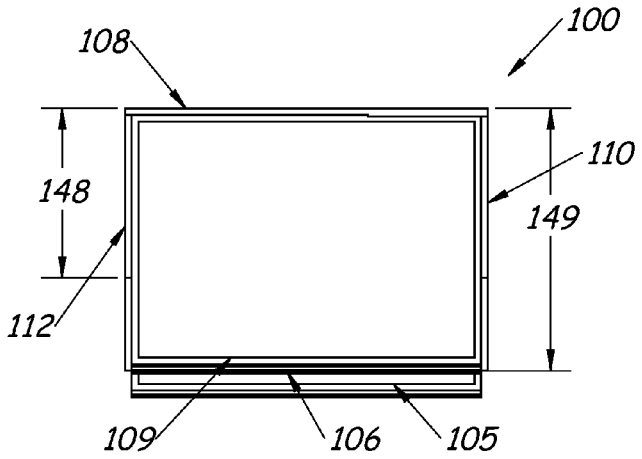
FIG. 4 is a top view of the display fixture illustrated in FIG. 1.

FIG. 1 is a perspective view of a display fixture 100 according to one embodiment. FIG. 2 is a front view of the display fixture 100 illustrated in FIG. 1, the back being unornamented. FIG. 3 is a section view of the display fixture 100 illustrated in FIG. 1 taken along the line indicated in FIG. 2. FIG. 4 is a top view of the display fixture 100 illustrated in FIG. 1, the bottom being unornamented. In one embodiment, display fixture 100 can display shelf-type products. For example, display fixture 100 can display packages of clothing, such as packaged undergarments and the like.

Figure 5:
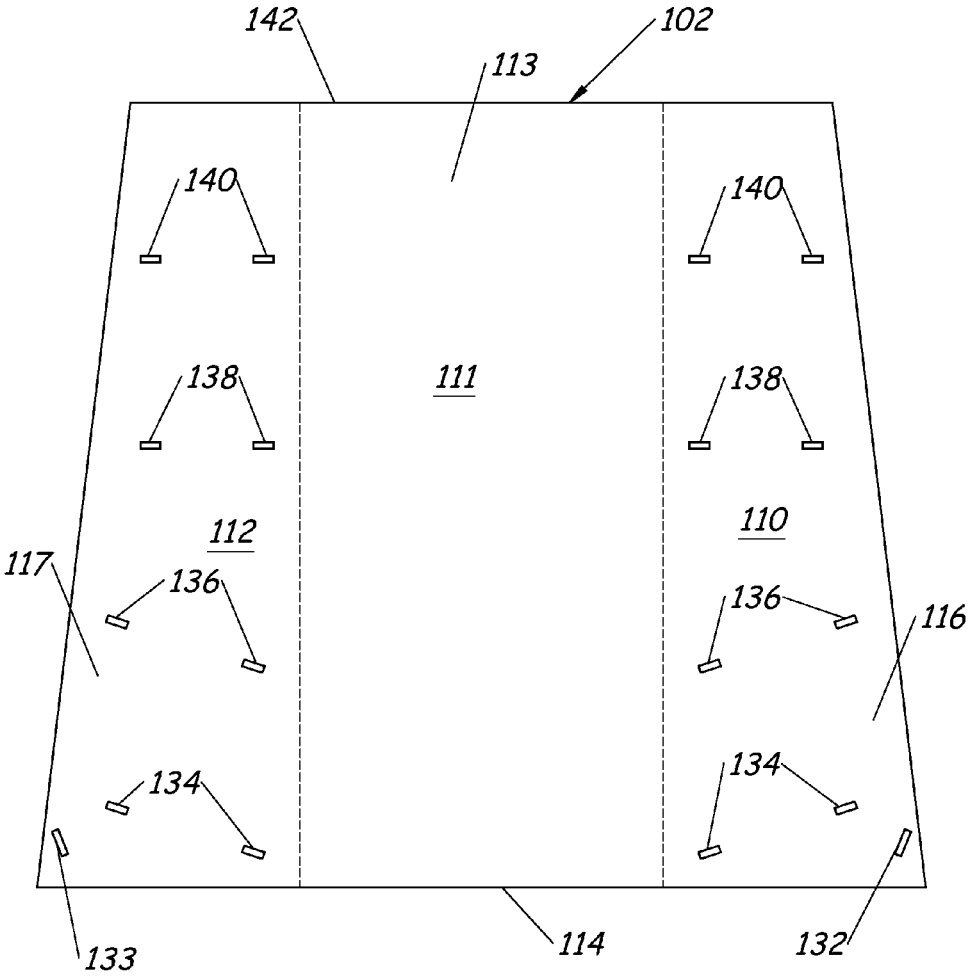
FIG. 5 is a plan view of a main body of the display fixture illustrated in FIG. 1 in a substantially planar configuration.
Figure 7:
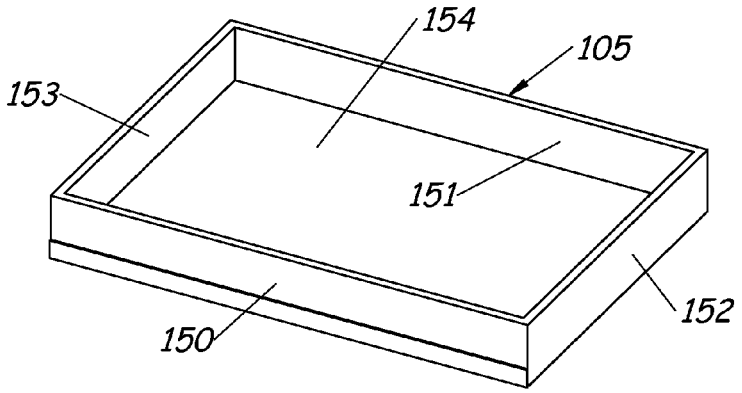
FIG. 7 is a perspective view of an assembled shelf tray of the display fixture illustrated in FIG. 1.
Figure 6:
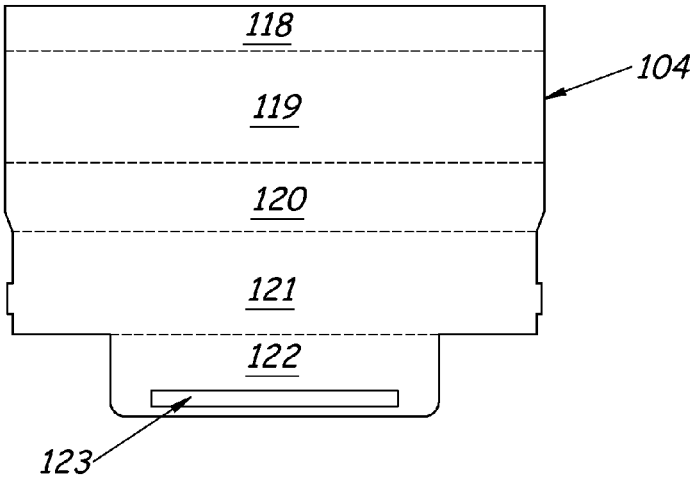
FIG. 6 is a plan view of a toe kick of the display fixture illustrated in FIG. 1 in a substantially planar configuration.
Figure 8:
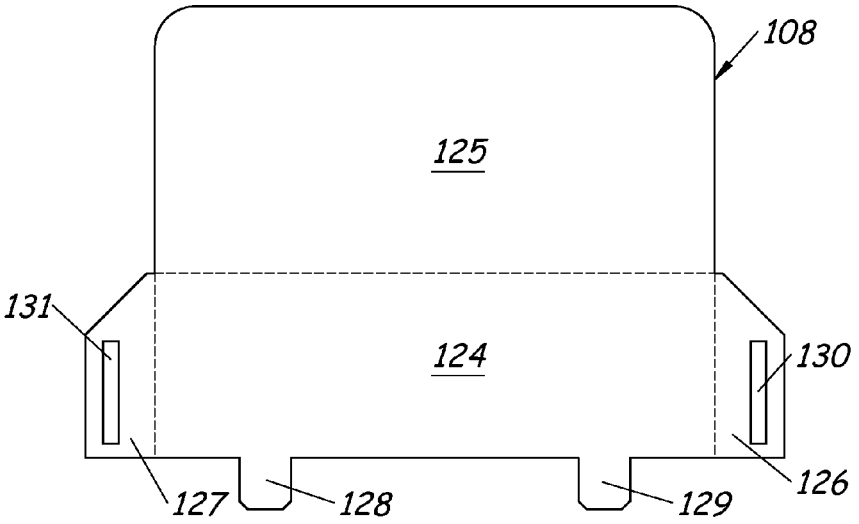
FIG. 8 is an enlarged plan view of a header of the display fixture illustrated in FIG. 1 in a substantially planar configuration.

Each component of display fixture 100 is shipped to a retail store flat or in a substantially planar configuration and is lightweight, inexpensive, and recyclable. For example, FIG. 5 illustrates a plan view of a main body or upright component 102 in a substantially planar configuration, FIG. 6 illustrates a plan view of a toe kick 104 in a substantially planar configuration, FIG. 7 illustrates a perspective view of an exemplary assembled shelf tray 105, which includes and is formed of multiple flat components and FIG. 8 illustrates an enlarged plan view of a header 108 in a substantially planar configuration. Main body or upright component 102, toe kick 104, shelf tray 105 and header 108 are all parts of display fixture 100 that are shipped to a retail store flat for later assembly. In light of the substantially planar configurations, in one embodiment, display fixture 100 is a temporary display fixture that can be used during a particular shopping season and then easily deconstructed for disposal. For example, main body 102, toe kick 104, shelf tray 105 and header 108 of display fixture 100 can be made of corrugated cardboard. In FIGS. 5-8, all solid lines represent free edges while all dashed lines represent scores or folds.

As illustrated in FIG. 5 and in one embodiment, main body 102 includes three panels or sections coupled together by scores or folds including a right side panel or section 110, a center panel or section 111 and a left side panel or section 112. In another embodiment, main body 102 including right side panel 110, center panel 111 and left side panel 112 can be three separate panels that form main body 102. Each of three panels or sections including right side panel 110, center panel 111 and left side panel 112 have interior surfaces 116, 113 and 117, respectively. Right side panel 110 and left side panel 112 include an arrangement of clips that will couple other components of display fixture 100 to main body 102. To erect main body 102 from the substantially planar configuration illustrated in FIG. 5, main body 102 is stood up on its bottom edge 114 and right side panel 110 and left side panel 112 are folded inwardly such that inner facing surface 116 of right side panel or section 110 faces inner facing surface 117 of left side panel or section 112 and inner facing surface 113 of center panel or section 111 faces forward.

As illustrated in the substantially planar configuration of FIG. 6, toe kick 104 includes five panels coupled together by scores or folds including a top panel 118, a front panel 119, a bottom panel 120, a back panel 121 and an inside panel 122. Inside panel 122 includes an adhesive strip 123 having a backing. From its substantially planar configuration, further assembly is needed to configure toe kick 104 into the usable configuration illustrated in FIGS. 1-4. In particular, the backing on the adhesive strip 123 is removed and back panel 121 is folded up and over so that the inside panel 122 is secured to the interior of front panel 119 with adhesive 123. The assembly of toe kick 104 is illustrated in the section view illustrated in FIG. 3.

FIG. 7 is an exemplary assembled shelf tray 105. Shelf tray 105, like the shelf trays discussed below, are shipped to a retail store flat and then assembled to include a front wall 150, a back wall 151, a right side wall 152, a left side wall 153 and a floor 154. Floor 154 supports the product to be displayed by shelf tray 105, while walls 150, 151, 152 and 153 provide structure for preventing product from falling off shelf tray 105.

As illustrated in the substantially planar configuration of FIG. 8, header 108 includes a front panel 124, a back panel 125 coupled to front panel 124 by a score or fold, a right side flap 126 coupled to front panel 124 by a score or fold, a left side flap 127 coupled to front panel 124 by a score or fold and a pair of downward depending tabs 128 and 129 extending from an edge of front panel 124 that is opposite the score or fold that connects back panel 125 to front panel 124. Right side flap 126 includes an adhesive strip 130 having a backing and left side flap 127 also includes an adhesive strip 131 having a backing. From its substantially planar configuration, further assembly is needed to configure header 108 into the usable configuration illustrated in FIGS. 1-4. In particular, back panel 125 is folded over the interior side of front panel 124. Backings on the adhesive strips 130 and 131 are removed and right side flap 126 and left side flap 127 are folded over the exterior side of back panel 125 and secured with adhesive 130 and 131. Although not illustrated in FIG. 8, a front facing surface of front panel 124 can include indicia.

To assemble display fixture 100, assembled toe kick 104 is aligned and inserted into front clips 132 and 133 (FIG. 5) and therefore located between right side panel 110 and left side panel 112 near bottom edge 114 of main body 102. Next, a plurality of substantially identical assembled shelf trays including lower shelf trays 105 and 106 and upper shelf trays 107 and 109 are aligned and inserted into side clips located on right side panel 110 and left side panel 112. More specifically, first lower shelf tray 105 is located above toe kick 104 and is aligned and inserted into bottom or first side clips 134 (FIG. 5) on main body 102. Bottom side clips 134 are located near front clips 132 and 133. A second lower shelf tray 106 located above first lower shelf tray 105 is aligned and inserted into second side clips 136 (FIG. 5) on main body 102. Second side clips 136 are located above bottom clips 134. A first upper shelf tray 107 is located above second lower shelf tray 106 and is aligned and inserted into third side clips 138 (FIG. 5) on main body 102. Third side clips 138 are located above second side clips 136. Second upper shelf tray 109 is located above first upper shelf tray 107 and is aligned and inserted into top or fourth side clips 140 (FIG. 5) on main body 102. Top or fourth side clips 140 are located above third side clips 138. While display fixture 100 is illustrated as having two lower shelf trays 105 and 106 and two upper shelf trays 107 and 109, display fixture 100 can have any number of lower and upper shelf trays including, for example, a two lower shelf trays and three upper shelf trays and therefore any number of side clips for securing those shelf trays.

Still further, to assemble display fixture 100, the pair of downward depending tabs 128 and 129 of header 108 are inserted into slots located along a top edge 142 (FIG. 5) of main body 102. More particularly, the slots are located along top edge 142 of center panel 111. Header 108 is pressed down until assembled front panel 124 is flush with top edge 142 of main body 102.

With reference to FIGS. 1-4, fully assembled display fixture 100 includes main body 102 having substantially vertically oriented right side panel 110, center panel 111 and left side panel 112. Further, main body 102 includes front facing edges 144 and 145. Front facing edge 144 defines a free edge of right side panel 110 and front facing edge 145 defines a free edge of left side panel 112. Right side panel 110 and left side panel 112 taper along front facing edges 144 and 145 from bottom edge 114 to top edge 142 of main body 102. In other words, right side panel 110 and left side panel 112 include substantially similar top edge depths 148 (FIGS. 3 and 4) and substantially similar bottom edge depths 149 (FIGS. 3 and 4). Top edge depth 148 is less than bottom edge depth 149. In this way, product being displayed on upper shelf trays 107 and 109 and lower shelf trays 105 and 106 can be better viewed and accessed. Floors 154 of upper shelf trays 107 and 109 are oriented substantially parallel to top edge 142 and bottom edge 114 of main body 102 using clips 138 and 140 located on right side panel 110 and left side panel 112 because these shelf trays 107 and 109 are located closest to the viewing level of a customer. Floors 154 of lower shelf trays 105 and 106, however, are oriented at an angle 146 from bottom edge 114 of main body 102 because these shelf trays 106 are located furthest from the viewing level of a customer. More particularly, the customer will be looking down at lower shelf trays 105 and 106. Angle 146 is an acute angle (i.e., greater than zero degrees and less than 90 degrees) and orients lower shelf trays 105 and 106 so that front walls 150 are located closer to top edge 142 of main body 102 than back walls 151. Likewise, back walls 151 are located closer to bottom edge 114 of main body 102 than front walls 150. This angled orientation of shelf trays 105 and 106 allow a customer to better see all of the packages located on shelf trays 105 and 106 for ease of identifying and selecting clothing sizes.

A front facing surface of front panel 124 of header 108 includes a sign holder 156. Sign holder 156 is a pocket made of, for example, an extruded polymer and is configured to receive a sign or graphic. While display fixture 100 illustrates sign holder 156 being located across only a portion of the front facing surface of front panel 124, sign holder 156 can be large enough to extend across the entire exterior surface of front panel 124. In addition, the front facing surfaces of front walls 150 of each shelf tray 105, 106, 107 and 109 includes a label holder 155 (FIG. 1) made of, for example, an extruded polymer and is configured to receive at least one price label.

Figure 9:
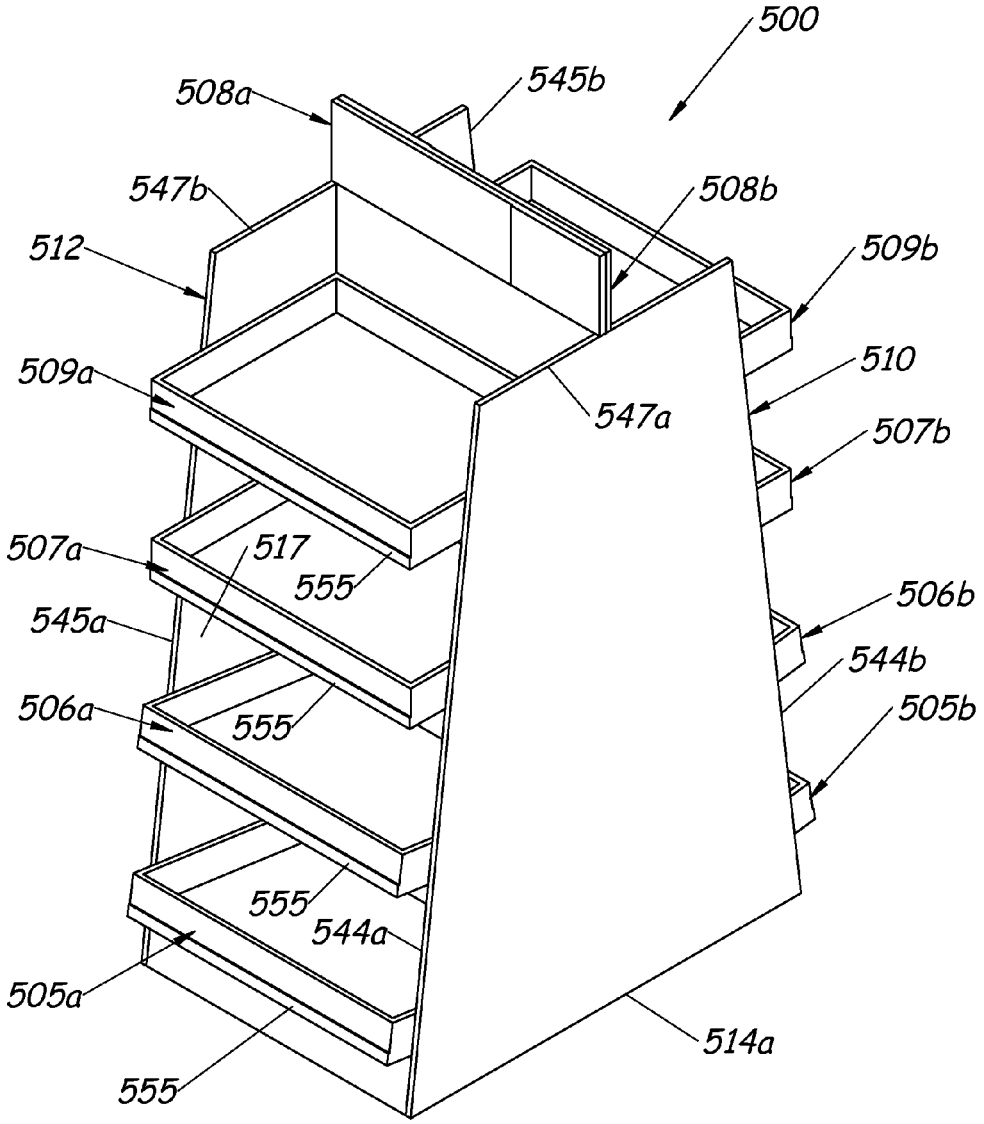
FIG. 9 is a perspective view of a display fixture according to another embodiment.
Figure 10:
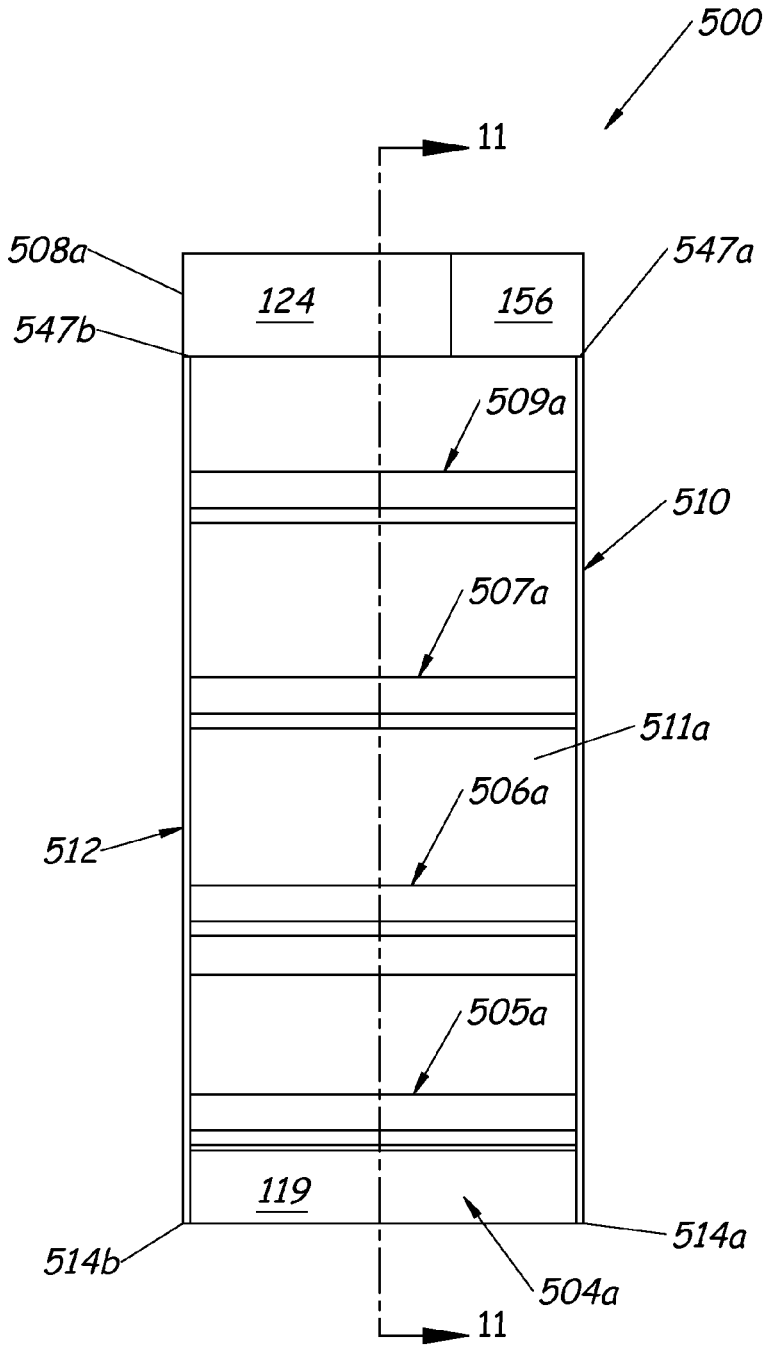
FIG. 10 is a front view of the display fixture illustrated in FIG. 9.
Figure 11:
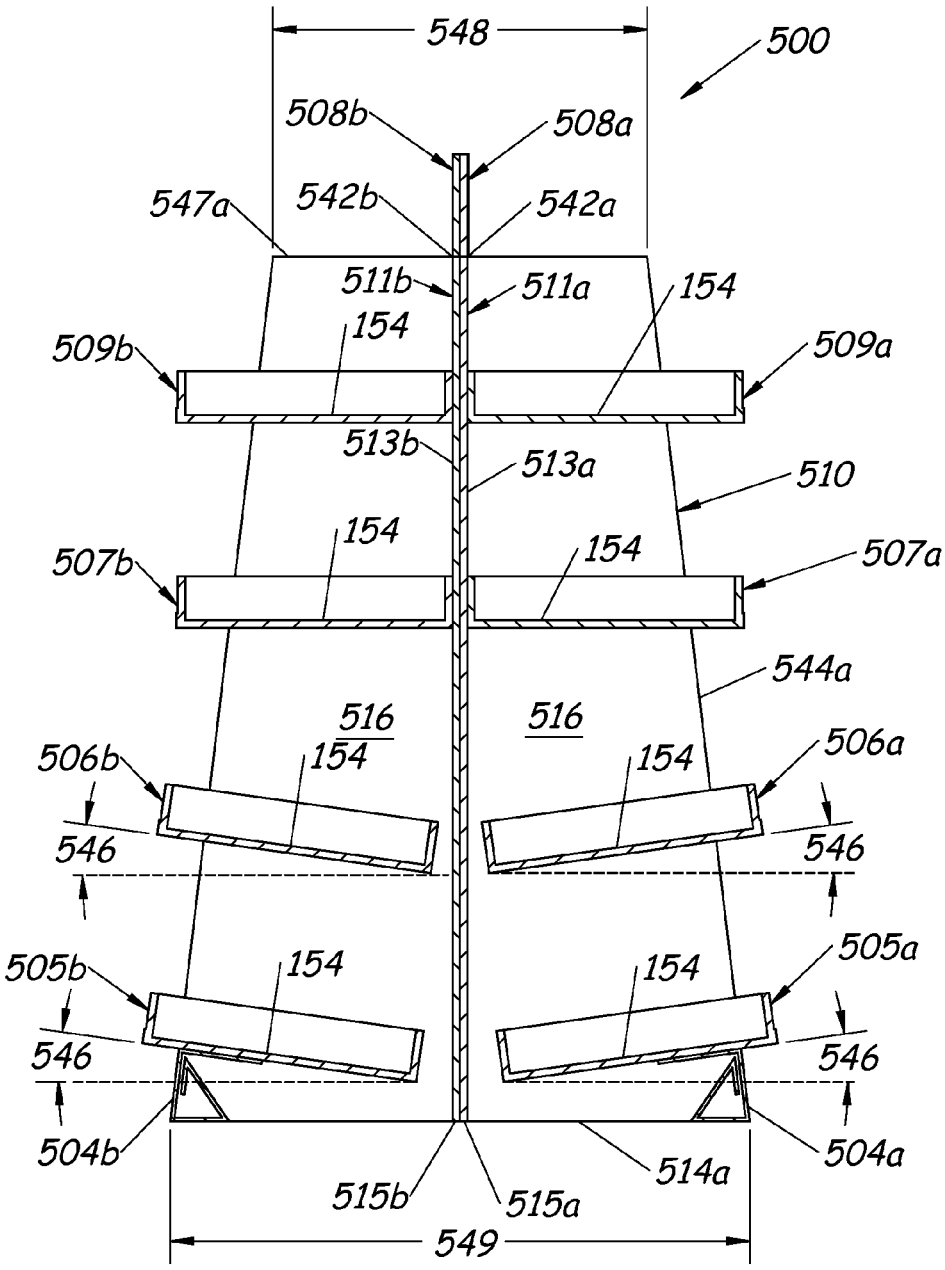
FIG. 11 is a section view of the display fixture illustrated in FIG. 9 taken along the line indicated in FIG. 10.
Figure 12:
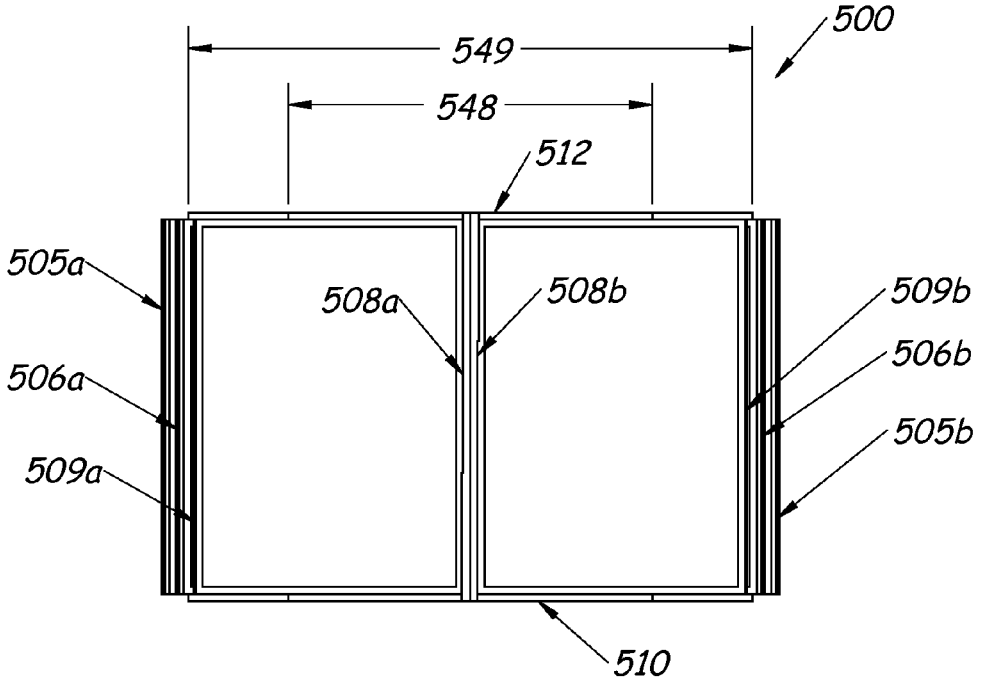
FIG. 12 is a top view of the display fixture illustrated in FIG. 9.

FIG. 9 is a perspective view of a display fixture 500 according to another embodiment. Display fixture 500 is similar to display fixture 100 in that display fixture 500 is a back-to-back version of display fixture 100, but is dissimilar to display fixture 100 in certain structural features. For example, the main body of display fixture 500 includes multiple parts rather than a main body having three panels connected by fold lines. FIG. 10 is a front view of the display fixture 500 illustrated in FIG. 9, the back being identical. FIG. 11 is a section view of the display fixture 500 illustrated in FIG. 9 taken along the line indicated in FIG. 10. FIG. 12 is a top view of the display fixture 500 illustrated in FIG. 9, the bottom being unornamented. In one embodiment, display fixture 500 can display shelf-type products. For example, display fixture 500 can display packages of clothing, such as packaged undergarments and the like.

Each component of display fixture 500 is shipped to a retail store flat or in a substantially planar configuration and is lightweight, inexpensive, and recyclable. In light of the substantially planar configurations of the components, in one embodiment, display fixture 500 is a temporary display fixture that can be used during a particular shopping season and then easily deconstructed for disposal. For example, components of display fixture 500 can be made of corrugated cardboard.

As illustrated in FIGS. 9-12 and in one embodiment, the main body of display fixture 500 includes two side panels 510 and 512 and two center panels 511*a* and 511*b*. In an alternative embodiment, display fixture 500 can include a pair of main bodies positioned back-to-back and each having three panels or sections coupled together by scores or folds including a right side panel or section, a center panel or section and a left side panel or section. Each of side panels 510 and 512 and the center panels 511*a* and 511*b* have interior surfaces 516, 517, 513*a* and 513*b*, respectively. Side panels 510 and 512 include an arrangement of clips that will couple other components of display fixture 500 to the main body. To erect the main body including side panels 510 and 512 and center panels 511*a* and 511*b* from their substantially planar configuration, side panels 510 and 512 and center panels 511*a* and 511*b* are stood up on their bottom edges 514*a* and 514*b* and 515*a* and 515*b*, are oriented, assembled and attached together such that center panels 511*a* and 511*b* are positioned back-to-back and are located substantially perpendicular to and between side panels 510 and 512. Therefore, inner facing surface 516 of side panel 510 faces inner facing surface 517 of side panel 512, inner facing surface 513*a* of center panel 511*a* faces forward and inner facing surface 513*b* of center panel 511*b* faces backward.

Display fixture 500 also includes two toe kicks 504*a* and 504*b*. Each toe kick 504*a* and 504*b* is substantially similar to the toe kick 104 illustrated in a planar configuration in FIG. 6. From its substantially planar configuration, further assembly is needed to configure toe kicks 504*a* and 504*b* into the usable configurations illustrated in FIGS. 9-12. In particular and as illustrated in FIG. 6, the backing on the adhesive strip 123 is removed and back panel 121 is folded up and over so that the inside panel 122 is secured to the interior of front panel 119 with adhesive 123. The assembly of toe kicks 504*a* and 504*b* are illustrated in the section view illustrated in FIG. 11.

Display fixture 500 also includes eight shelf trays 505*a*, 505*b*, 506*a*, 506*b*, 507*a*, 507*b*, 509*a* and 509*b*. Each of the eight shelf trays is substantially similar to the exemplary assembled shelf tray 105 illustrated in FIG. 7. Each of the eight shelf trays is shipped to a retail store flat and then assembled to include a front wall 150, a back wall 151, a right side wall 152, a left side wall 153 and a floor 154. Floor 154 supports the product to be displayed, while walls 150, 151, 152 and 153 provide structure for preventing product from falling off.

Display fixture 500 includes a pair of headers 508*a* and 508*b*. Each header 508*a* and 508*b* is substantial similar to header 108 illustrated in the substantially planar configuration in FIG. 8 and includes a front panel 124, a back panel 125 coupled to front panel 124 by a score or fold, a right side flap 126 coupled to front panel 124 by a score or fold, a left side flap 127 coupled to front panel 124 by a score or fold and a pair of downward depending tabs 128 and 129 extending from an edge of front panel 124 that is opposite the score or fold that connects back panel 125 to front panel 124. Right side flap 126 includes an adhesive strip 130 having a backing and left side flap 127 also includes an adhesive strip 131 having a backing. From their substantially planar configurations, further assembly is needed to configure headers 508*a* and 508*b* into the usable configuration illustrated in FIGS. 9-12. In particular, back panel 125 is folded over the interior side of front panel 124. Backings on the adhesive strips 130 and 131 are removed and right side flap 126 and left side flap 127 are folded over the exterior side of back panel 125 and secured with adhesive 130 and 131. Although not illustrated in FIG. 8, a front facing surface of front panel 124 can include indicia.

To assemble display fixture 500, assembled toe kick 504*a* is aligned and inserted into a set of front clips that are attached to inner facing surfaces 516 and 517 of side panels 510 and 512 and therefore located between side panel 510 and side panel 512, forward of center panel 511*a* and near bottom edges 514*a* and 514*b*. Assembled toe kick 504*b* is aligned and inserted into a set of back clips that are attached to inner facing surface 516 and 517 of side panels 510 and 512 and therefore located between side panel 510 and side panel 512, backward of center panel 511*b* and near bottom edges 514*a* and 514*b*.

Next, a plurality of substantially identical assembled shelf trays including shelf trays 505*a*, 506*a*, 507*a* and 509*a* are aligned and inserted into front side clips located on side panel 510 and side panel 512 forward of center panel 511*a*. More specifically, shelf tray 505*a* is located above toe kick 504*a* and is aligned and inserted into a first set of front side clips. Shelf tray 506*a* is located above shelf tray 505*a* and is aligned and inserted into a second set of front side clips. The second set of front side clips are located above the first set of front side clips. Shelf tray 507*a* is located above shelf tray 506*a* and is aligned and inserted into a third set of front side clips. The third set of front side clips are located above the second set of front side clips. Shelf tray 509*a* is located above shelf tray 507*a* and is aligned and inserted into a fourth set of front side clips. The fourth set of front side clips are located above the third set of front side clips.

Still further, a plurality of substantially identical assembled shelf trays including shelf trays 505*b*, 506*b*, 507*b* and 509*b* are aligned and inserted into back side clips located on side panel 510 and side panel 512 backward of center panel 511*b*. More specifically, shelf tray 505*b* is located above toe kick 504*b* and is aligned and inserted into a first set of back side clips. Shelf tray 506*b* is located above shelf tray 505*b* and is aligned and inserted into a second set of back side clips. The second set of back side clips are located above the first set of back side clips. Shelf tray 507*b* is located above shelf tray 506*b* and is aligned and inserted into a third set of back side clips. The third set of back side clips are located above the second set of back side clips. Shelf tray 509*b* is located above shelf tray 507*b* and is aligned and inserted into a fourth set of back side clips. The fourth set of back side clips are located above the third set of back side clips. While display fixture 500 is illustrated as having eight shelf trays 505*a*, 505*b*, 506*a*, 506*b*, 507*a*, 507*b*, 509*a* and 509*b*, display fixture 500 can have any number of shelf trays and therefore any number of side clips for securing those shelf trays to side panels 510 and 512.

Still further, to assemble display fixture 500, the downward depending tabs 128 and 129 of headers 508*a* and 508*b* are inserted into slots located along top edges 542*a* and 542*b* of center panels 511*a* and 511*b*. Headers 508*a* and 508*b* are pressed down until the assembled front panels 124 are flush with top edges 542*a* and 542*b* of center panels 511*a* and 511*b*.

Fully assembled display fixture 500 includes the main body having substantially vertically oriented side panels 510 and 512 and center panels 511*a* and 511*b*. Side panels 510 and 512 includes front facing edges 544*a* and 545*a* and back facing edges 544*b* and 545*b*. Front facing and back facing edges 544*a* and 544*b* define free edges of side panel 510 and front facing and back facing edges 545*a* and 545*b* define free edges of side panel 512. Side panels 510 and 512 taper along front facing edges 544*a* and 545*a* and taper along back facing edges 544*b* and 545*b* from bottom edges 514*a* and 514*b* to top edges 547*a* and 547*b* of side panels 510 and 512. In other words, side panels 510 and 512 include substantially similar top edge depths 548 (FIGS. 11 and 12) and substantially similar bottom edge depths 549 (FIGS. 11 and 12). Top edge depth 548 is less than bottom edge depth 549. In this way, products being displayed on upper shelf trays 507*a*, 507*b*, 509*a* and 509*b* and lower shelf trays 505*a*, 505*b*, 506*a* and 506*b* can be better viewed and accessed. Floors 154 of upper shelf trays 507*a*, 507*b*, 509*a* and 509*b* are oriented substantially parallel to top edges 542*a* and 542*b* of center panels 511*a* and 511*b* and top edges 547*a* and 547*b* of side panels 510 and 512 and oriented substantially parallel to bottom edges 514*a* and 514*b* of side panels 510 and 512 because these shelf trays are located closest to the viewing level of a customer. Floors 154 of lower shelf trays 505*a*, 505*b*, 506*a* and 506*b*, however, are oriented at an angle 546 from bottom edges 514*a* and 514*b* of side panels 510 and 512 because these shelf trays 106 are located furthest from the viewing level of a customer. More particularly, the customer will be looking down at lower shelf trays 505*a*, 505*b*, 506*a* and 506*b*. Angle 546 is an acute angle (i.e., greater than zero degrees and less than 90 degrees) and orients shelf trays 505*a*, 505*b*, 506*a* and 506*b* so that front walls 150 are located closer to top edges 542*a* and 542*b* of center panels 511*a* and 511*b* and top edges 547*a* and 547*b* of side panels 510 and 512 than back walls 151. Likewise, back walls 151 are located closer to bottom edges 514*a* and 514*b* of side panels 510 and 512 than front walls 150. This angled orientation of shelf trays 505*a*, 505*b*, 506*a* and 506*b* allow a customer to better see all of the packages located on shelf trays 505*a*, 505*b*, 506*a* and 506*b* for ease of identifying and selecting clothing sizes.

A front facing surface of front panel 124 of header 508*a* and of header 508*b* includes a sign holder 156. Sign holder 156 is a pocket made of, for example, an extruded polymer and is configured to receive a sign or graphic. While display fixture 500 illustrates sign holder 156 being located across only a portion of the front facing surface of front panel 124, sign holder 156 can be large enough to extend across the entire exterior surface of front panel 124. In addition, the front facing surfaces or back facing surfaces of front walls 150 of each shelf tray 505*a*, 505*b*, 506*a*, 506*b*, 507*a*, 507*b*, 509*a* and 509*b* includes a label holder 555 (FIG. 9) made of, for example, an extruded polymer and is configured to receive at least one price label.

Figure 16:
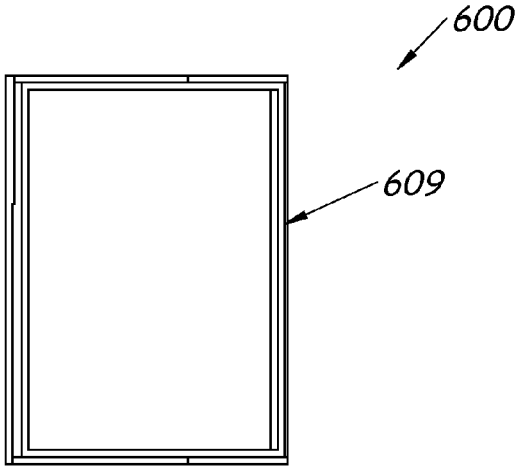
FIG. 16 is a top view of the display fixture illustrated in FIG. 13.
Figure 13:
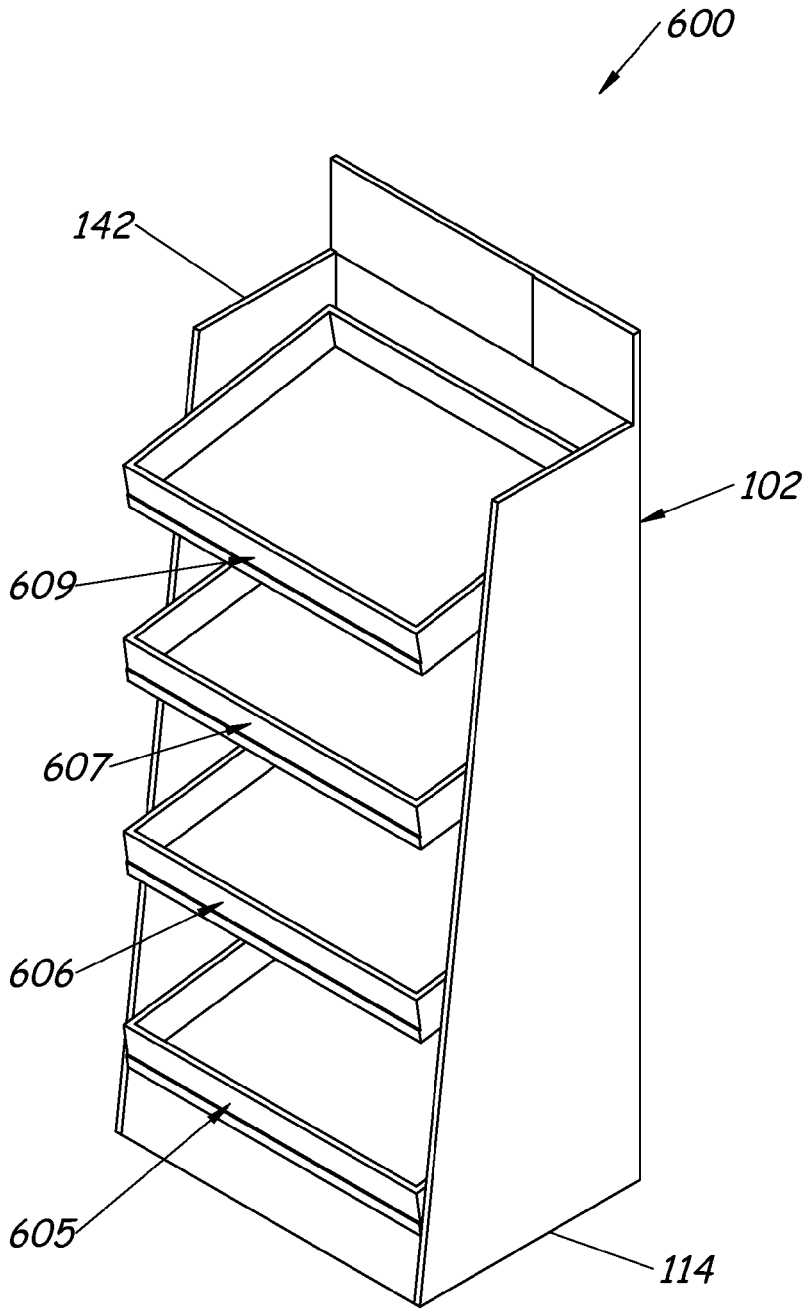
FIG. 13 is a perspective view of a display fixture according to another embodiment.
Figure 14:
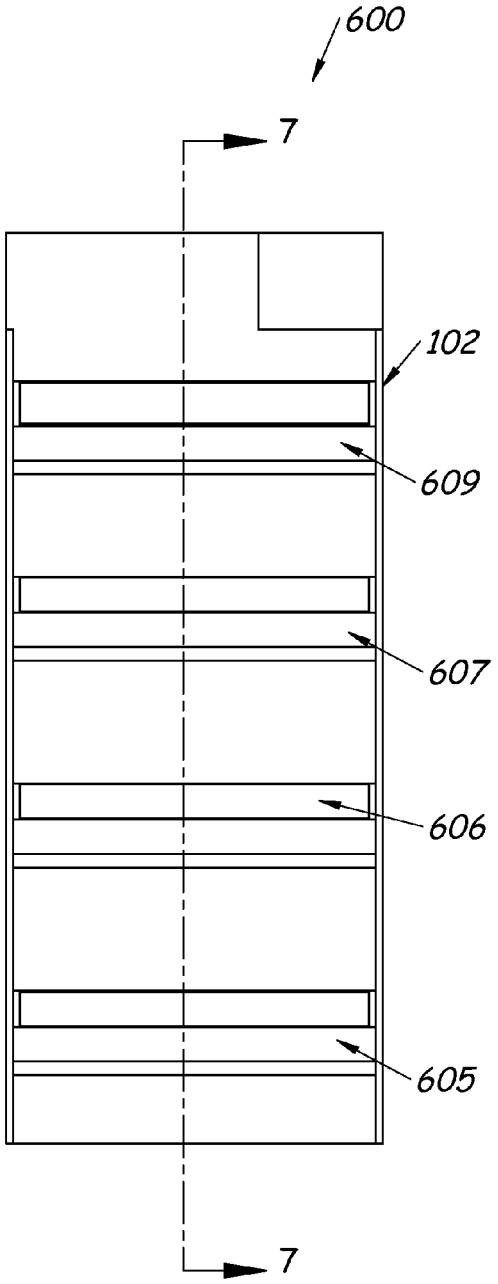
FIG. 14 is a front view of the display fixture illustrated in FIG. 13.
Figure 15:
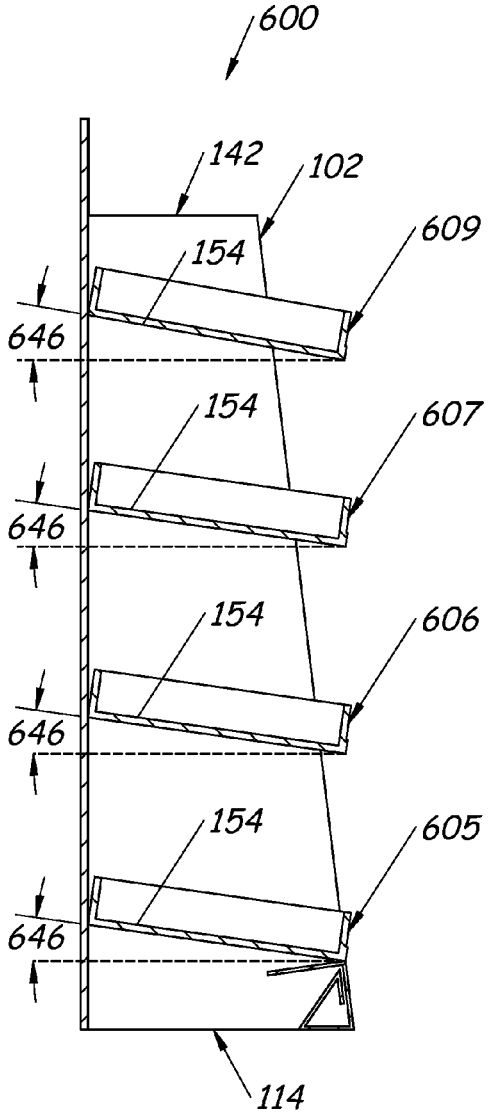
FIG. 15 is a section view of the display fixture illustrated in FIG. 13 taken along the line indicated in FIG. 14.

FIG. 13 is a perspective view of a display fixture 600 according to another embodiment. Display fixture 600 is similar to display fixture 100, but includes shelf trays 605, 606, 607 and 609 that are oriented at a different angle 646 than the angles at which shelf trays 105, 106, 107 and 109 are oriented. FIG. 14 is a front view of the display fixture 600 illustrated in FIG. 13, the back being unornamented. FIG. 15 is a section view of the display fixture 600 illustrated in FIG. 13 taken along the line indicated in FIG. 14. FIG. 16 is a top view of the display fixture 600 illustrated in FIG. 13, the bottom being unornamented. In one embodiment, display fixture 600 can display shelf-type products. For example, display fixture 600 can support folded clothing, such as folded t-shirts and the like.

Each of the four shelf trays 605, 606, 607 and 609 of display fixture 600 is substantially similar to the exemplary assembled shelf tray 105 illustrated in FIG. 7. Each of the four shelf trays is shipped to a retail store flat and then assembled to include a front wall 150, a back wall 151, a right side wall 152, a left side wall 153 and a floor 154. Floor 154 supports the product to be displayed, while walls 150, 151, 152 and 153 provide structure for preventing product from falling off.

Floors 154 of upper shelf trays 607 and 609 and floors 154 of lower shelf trays 605 and 606 are all oriented at substantially the same angle 646 from bottom edge 114 of main body 102. Shelf trays 605, 606, 607 and 609 are all oriented at angle 646 to better display and allow for customer access of folded clothing, such as folded t-shirts. More particularly, the customer will be looking down at shelf trays 605, 606, 607 and 609. Angle 146 is an acute angle (i.e., greater than zero degrees and less than 90 degrees) and orients shelf trays 605, 606, 607 and 609 so that front walls 150 are located closer to bottom edge 114 of main body 102 than back walls 151 are to bottom edge 114. Likewise, back walls 151 are located closer to top edge 142 of main body 102 than front walls 150 are to top edge 142. This angled orientation of shelf trays 605, 606, 607 and 608 allow a customer to better see all of the folded clothing located on shelf trays 605, 606, 607 and 608 for ease of identifying and selecting clothing sizes.

Figure 17:
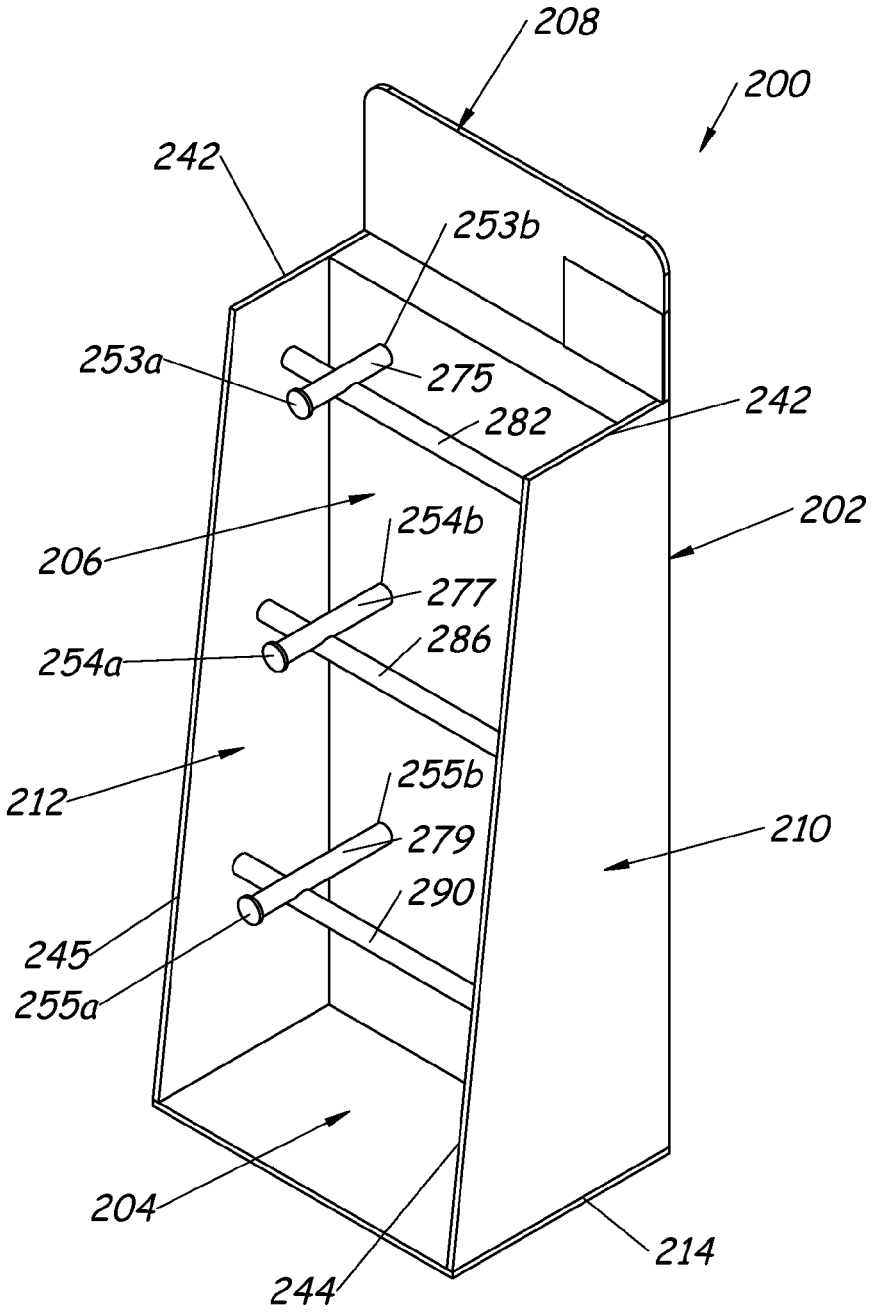
FIG. 17 is a perspective view of a display fixture according to another embodiment.
Figure 18:
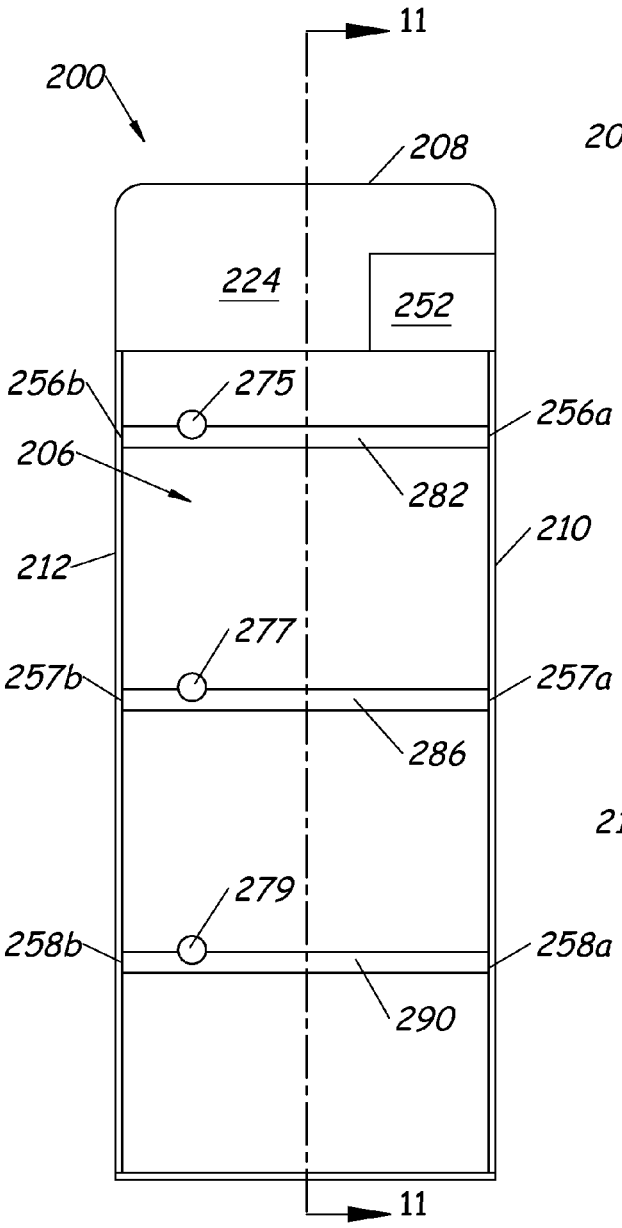
FIG. 18 is a front view of the display fixture illustrated in FIG. 17.
Figure 19:
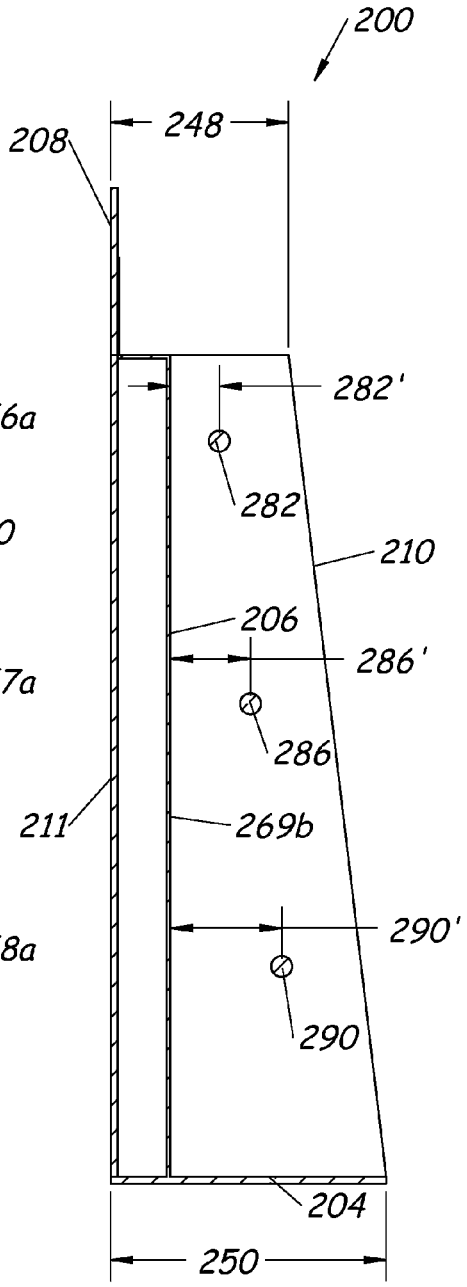
FIG. 19 is a section view of the display fixture illustrated in FIG. 17 taken along the line indicated in FIG. 18.
Figure 20:
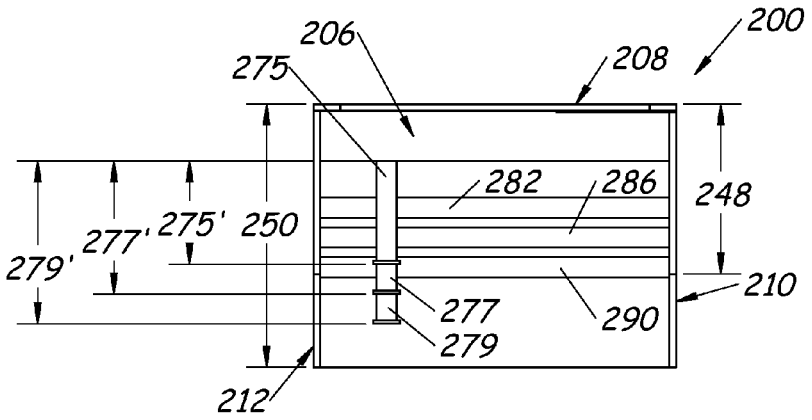
FIG. 20 is a top view of the display fixture in FIG. 17.

FIG. 17 is a perspective view of a display fixture 200 according to another embodiment. FIG. 18 is a front view of the display fixture 200 illustrated in FIG. 17, the back being unornamented. FIG. 19 is a section view of the display fixture 200 illustrated in FIG. 17 taken along the line indicated in FIG. 18. FIG. 20 is a top view of the display fixture 200 illustrated in FIG. 17, the bottom being unornamented. In one embodiment, display fixture 200 can display rack-type products. For example, display fixture 200 can display packages of clothing, such as undergarments, that include hangers for hanging the packages on a rod and the like.

Figure 21:
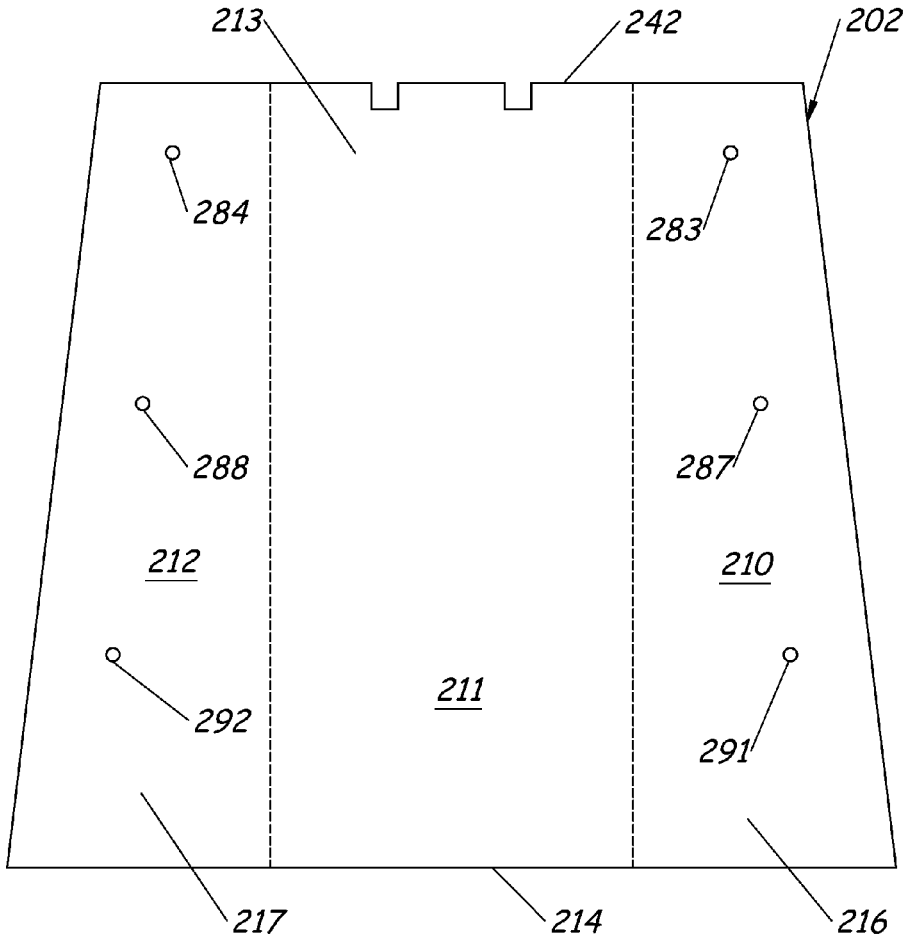
FIG. 21 is a plan view of a main body of the display fixture illustrated in FIG. 17 in a substantially planar configuration.
Figure 22:
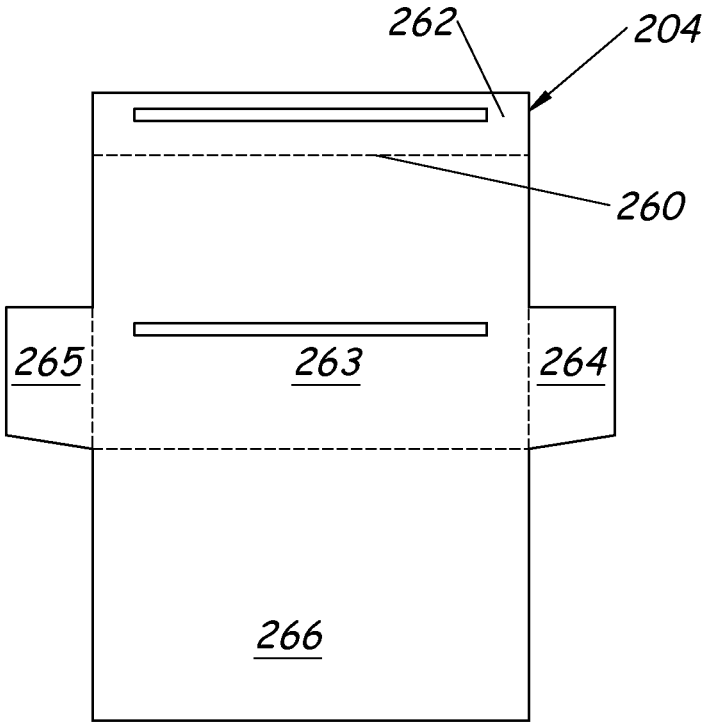
FIG. 22 is a plan view of a bottom component of the display fixture illustrated in FIG. 17 in a substantially planar configuration.
Figure 23:
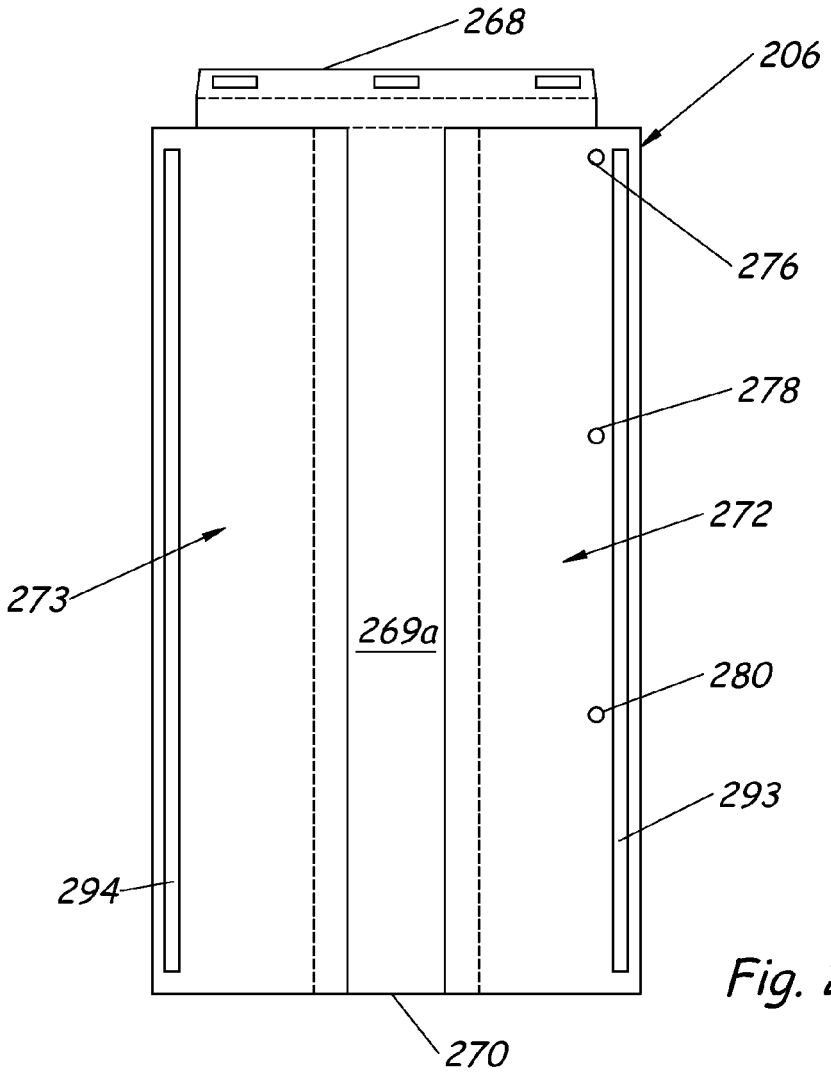
FIG. 23 is a plan view of a center component of the display fixture illustrated in FIG. 17 in a substantially planar configuration.
Figure 24:
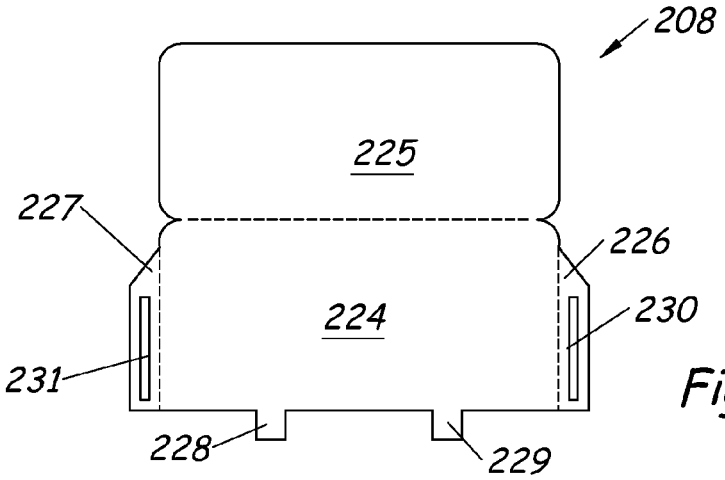
FIG. 24 is a plan view of a header of the display fixture illustrated in FIG. 17 in a substantially planar configuration.

Each component of display fixture 200 is shipped to a retail store flat or in a substantially planar configuration and is lightweight, inexpensive, and recyclable. For example, FIG. 21 illustrates a plan view of a main body or upright component 202 in a substantially planar configuration, FIG. 22 illustrates a plan view of a bottom component 204 in a substantially planar configuration, FIG. 23 illustrates a plan view of a center component 206 in a substantially planar configuration and FIG. 24 illustrates a plan view of a header 208 in a substantially planar configuration. Main body or upright component 202, bottom component 204, center component 206 and header 208 are all parts of display fixture 200 that are shipped to a retail store flat for later assembly. In light of the substantially planar configurations, in one embodiment, display fixture 200 is a temporary display fixture that can be used during a particular shopping season and then easily deconstructed for disposal. For example, main body 202, bottom component 204, center component 206 and header 208 of display fixture 200 can be made of corrugated cardboard. In FIGS. 21-24, all solid lines represent free edges while all dashed lines represent scores or folds.

As illustrated in FIG. 21 and in one embodiment, main body 202 includes three panels or sections coupled together by scores or folds including a right side panel or section 210, a center panel or section 211 and a left side panel or section 212. In another embodiment, main body 202 including right side panel 210, center panel 211 and left side panel 212 can be three separate panels that form main body 102. Each of the three panels or sections including right side panel 210, center panel 211 and left side panel 212 have interior surfaces 216, 213 and 217, respectively. Right side panel 210 and left side panel 212 include an arrangement of holes 283, 284, 287, 288, 291 and 292 that will receive other components of display fixture 200. Bottom component 204 includes a back 262, a top inside 263, side flaps 264 and 265 and top outside 266. Bottom component 204 includes a score or fold 260 that runs a width of back 262 and top inside 263 and separates back 262 from top inside 263. Center component 206 includes a top edge 268, back surfaces including back surface 269*a*, front surface 269*b* (FIG. 19), a bottom edge 270 and a pair of channels 272 and 273. Channel 272 includes holes 276, 278 and 280 for receiving face out bars of display fixture 200. The holes 276, 278 and 280 extend through channel 272 including all the way through the front surface 269*b* of center component 206. In the substantially planar configuration, the pair of channels 272 and 273 of center member 206 lie flat against back 269. Before center component 206 can be assembled to main body 202, the pair of channels 272 and 273 are opened to form rectangular tubes.

As illustrated in the substantially planar configuration of FIG. 24, header 208 includes a front panel 224, a back panel 225 coupled to front panel 224 by a score or fold, a right side flap 226 coupled to front panel 224 by a score or fold, a left side flap 227 coupled to front panel 224 and a pair of downward depending tabs 228 and 229 extending from an edge of front panel that is opposite the score or fold that connects back panel 225 to front panel 224. Right side flap 226 includes an adhesive strip 230 having a backing and left side flap 227 also includes an adhesive strip 231 having a backing. From its substantially planar configuration, further assembly is needed to configure header 208 into the usable configuration illustrated in FIGS. 17-20. In particular, back panel 225 is folded over the interior side of front panel 224. Backings on the adhesive strips 230 and 231 are removed and right side flap 226 and left side flap 227 are folded over the exterior side of back panel 225 and secured with adhesive 230 and 231. Although not illustrated in FIG. 24, a front facing surface of front panel 224 can include indicia.

To assemble main body 202, bottom component 204, center component 206 and header 208 from the substantially planar configurations illustrated in FIGS. 21-24 are assembled into the assembled display fixture 200 illustrated in FIGS. 17-20. Back 262 of bottom component 204 while still flat, is partially placed under main body 202, while still flat, such that a bottom edge 214 of main body 202 aligns with score or fold 260 of bottom component 204. Right side panel 210 and left side panel 212 are folded up so that inner facing surface 216 of right side panel or section 210 faces inner facing surface 217 of left side panel or section 212. Next, side flaps 264 and 265 of bottom component 204 are folded up and inserted into slots of main body 202 that are along the portions of bottom edge 214 that extend along right side panel 210 and left side panel 212. From here, main body 202 (assembled to bottom component 204) is stood up on bottom edge 214 and bottom component 204 (assembled to main body 202) is also stood up so that back 262, top inside 263 and top outside 262 lie on the floor and inner facing surface 213 of center panel or section 211 faces forward.

Further, an insert (not shown) is inserted into channel 272. The insert includes holes that are aligned with holes 276, 278 and 280 and provides support to channel 272. Center component 206 is stood up on bottom edge 270. An upper face out bar 275 includes a free end 253*a* cover by a cap, a fixed end 253*b* and a downward depending peg (not illustrated). Fixed end 253*b* is inserted into top hole 276 of channel 272 and is fixed in place by a plug that is mounted onto fixed end 253*b* of upper face out bar 275 from a back surface of center component 206. A middle face out bar 277 includes a free end 254*a* covered by a cap, a fixed end 254*b* and a downward depending peg (not illustrated). Fixed end 254*b* is inserted into middle hole 278 of channel 272 and is fixed in place by a plug that is mounted onto fixed end 254*b* of middle face out bar 277. A lower face out bar 279 includes a free end 255*a* covered by a cap, a fixed end 255*b* and a downward depending peg (not illustrated). Fixed end 255*b* is inserted into bottom hole 280 of channel 272 and is fixed in place by a plug that is mounted onto fixed end 255*b* of lower face out bar 279. The back surfaces of channels 272 and 273 include adhesive strips 293 and 294 having a backing. The backings are removed and the back surfaces of channels 272 and 273 are pressed against interior surface 213 of center panel 211 of main body 202. In addition, a backing from adhesive strip 295 located on top inside 263 of bottom component 204 is removed and top outside 266 of bottom member 204 is folded over and secured to top inside 263.

Further, an upper shoulder bar 282 includes a first fixed end 256*a* and a second fixed end 256*b*. Upper shoulder bar 282 is mounted to main body 202 by inserting first fixed end 256*a* into top hole 283 of right side panel 210, receiving the downward depending peg on upper face out bar 275 with a hole in the top of upper shoulder bar 282 and inserting second fixed end 256*b* into top hole 284 of left side panel 212. A plug is mounted onto each end 256*a* and 256*b* of upper shoulder bar 282 from exterior facing surfaces of right side panel 210 and left side panel 212 to secure upper shoulder bar 282 in place. A middle shoulder bar 286 includes a first fixed end 257*a* and a second fixed end 257*b*. Middle shoulder bar 286 is mounted to main body 202 by inserting first fixed end 257*a* into middle hole 287 of right side panel 210, receiving the downward depending peg on middle face out bar 277 with a hole in the top of middle shoulder bar 286 and inserting second fixed end 257*b* into middle hole 288 of left side panel 212. A plug is mounted onto each end 257*a* and 257*b* of middle shoulder bar 286 from exterior facing surfaces of right side panel 210 and left side panel 212 to secure middle shoulder bar 282 in place. A lower shoulder bar 290 includes a first fixed end 258*a* and a second fixed end 258*b*. Lower shoulder bar 290 is mounted to main body 202 by inserting first fixed end 258*a* into bottom hole 291 of right side panel 210, receiving the downward depending peg on lower face out bar 279 with a hole in the top of lower shoulder bar 290 and inserting second fixed end 258*b* into bottom hole 292 of left side panel 212. A plug is mounted onto each end 258*a* and 258*b* of lower shoulder bar 290 from exterior facing surfaces of right side panel 210 and left side panel 212 to secure lower shoulder bar 290 in place. After all face out bars 275, 277 and 279 and shoulder bars 282, 286 and 290 are mounted, back 262 of bottom component 204 is folded up and secured against the back of center panel 211 of main body 202 and top edge 268 of center member 206 is folded and secured against the exterior surface of center panel 211 of main body 202.

Still further, to assemble display fixture 200, the pair of downward depending tabs 228 and 229 of header 208 are inserted into slots located along a top edge 242 (FIG. 21) of main body 202. More particularly, the slots are located along top edge 242 of center panel 211. Header 208 is pressed down until assembled front panel 224 is flush with top edge 242 of main body 202.

With reference to FIGS. 17-20, fully assembled display fixture 200 includes main body 202 having substantially vertically oriented right side panel 210, center panel 211 and right side panel 212. Further, main body 202 includes front facing edges 244 and 245 (FIG. 17). Front facing edge 244 defines a free edge of right side panel 210 and front facing edge 245 defines a free edge of left side panel 212. Right side panel 210 and left side panel 212 taper along front facing edges 244 and 245 from bottom edge 214 to top edge 242 of main body 202. In other words, right side panel 210 and left side panel 212 include substantially similar top edge depths 248 (FIGS. 19 and 20) and substantially similar bottom edge depths 250. Top edge depth 248 is less than bottom edge depth 250. In addition and as illustrated in FIG. 20, the distances that face out bars 275, 277 and 279 protrude from center component 206 are all different. In particular, upper face out bar 275 extends a distance 275' from front surface 269*b* of center component 206 that is less than a distance 277' that middle face out bar 277 extends from front surface 269*b* of center component 206. Distance 277' that middle face out bar 277 extends from front surface 269*b* of center component 206 is less than a distance 279' that lower face out bar 279 extends from front surface 269*b* of center component 206. Further and as illustrated in FIG. 19, the distances at which shoulder bars 282, 286 and 290 are mounted to right side panel 210 and left side panel 212 relative to center component 206 are all different. In particular, upper shoulder bar 282 is mounted to right and left side panels 210 and 212 at a distance 282' from front surface 269*b* of center component 206. Middle shoulder bar 286 is mounted to right and left side panels 210 and 212 at a distance 286' from front surface 269*b* of center component 206, which is greater than distance 282'. Lower shoulder bar 290 is mounted to right and left side panels 210 and 212 at a distance 290' from front surface 269*b* of center component 206, which is greater than distance 286'. In other words, upper shoulder bar 282 is located closer to front surface 269*b* of center component 206 than middle shoulder bar 286 and middle shoulder bar 286 is located closer to front surface 269*b* of center component 206 than lower shoulder bar 290. In this way, product being displayed on face out bars 275, 277 and 279 and shoulder bars 282, 286 and 290 can be easily viewed and accessed by a customer whose eye level and arm reach would be closest to upper face out bar 275 and upper shoulder bar 282.

A front facing surface of front panel 224 of header 108 includes a sign holder 252. Sign holder 252 is a pocket made of, for example, an extruded polymer and is configured to receive a sign or graphic. While display fixture 200 illustrates sign holder 252 being located across only a portion of the front facing surface of front panel 224, sign holder 252 can be large enough to extend across the entire front facing surface of front panel 224.

Figure 25:
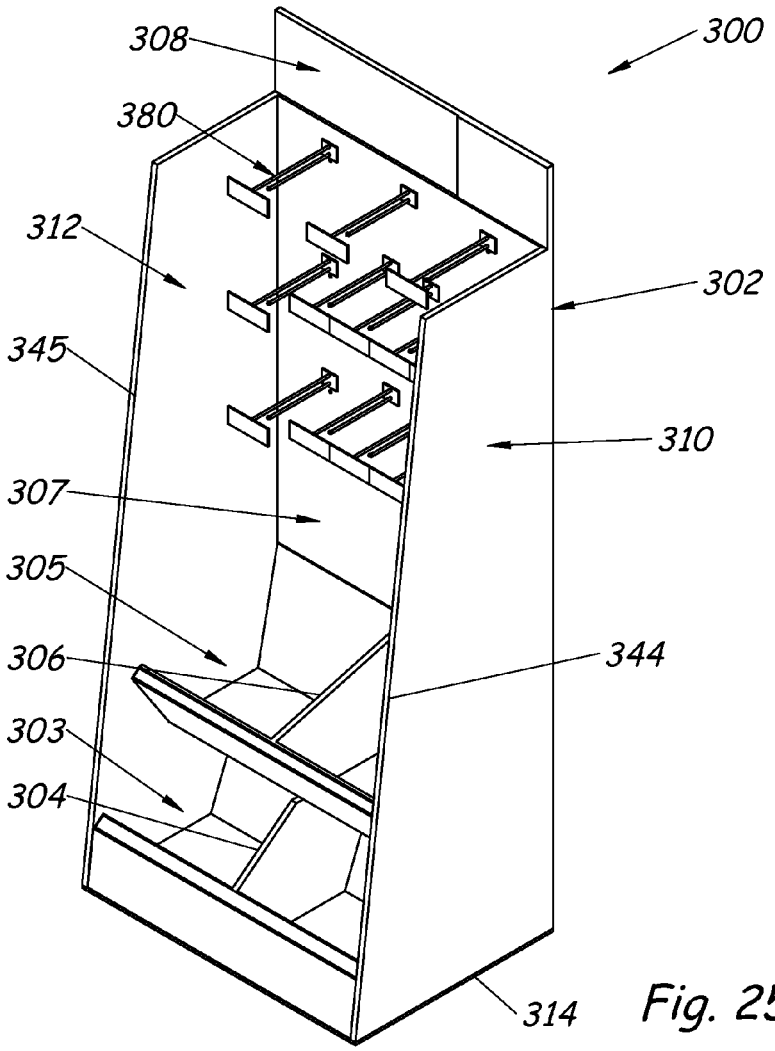
FIG. 25 is a perspective view of a display fixture according to yet another embodiment.
Figure 28:
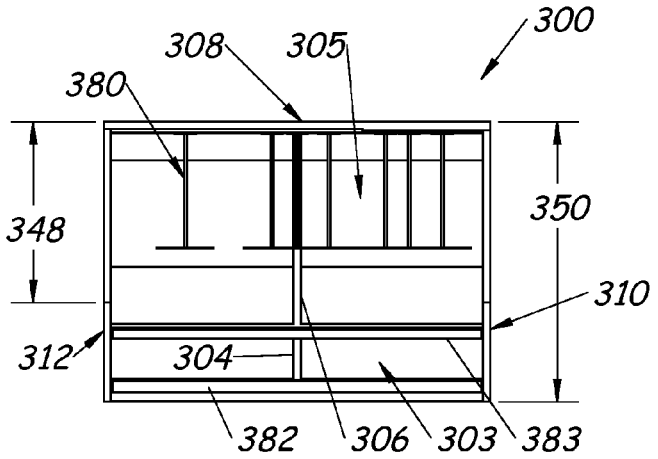
FIG. 28 is a top view of the display fixture illustrated in FIG. 25.
Figure 26:
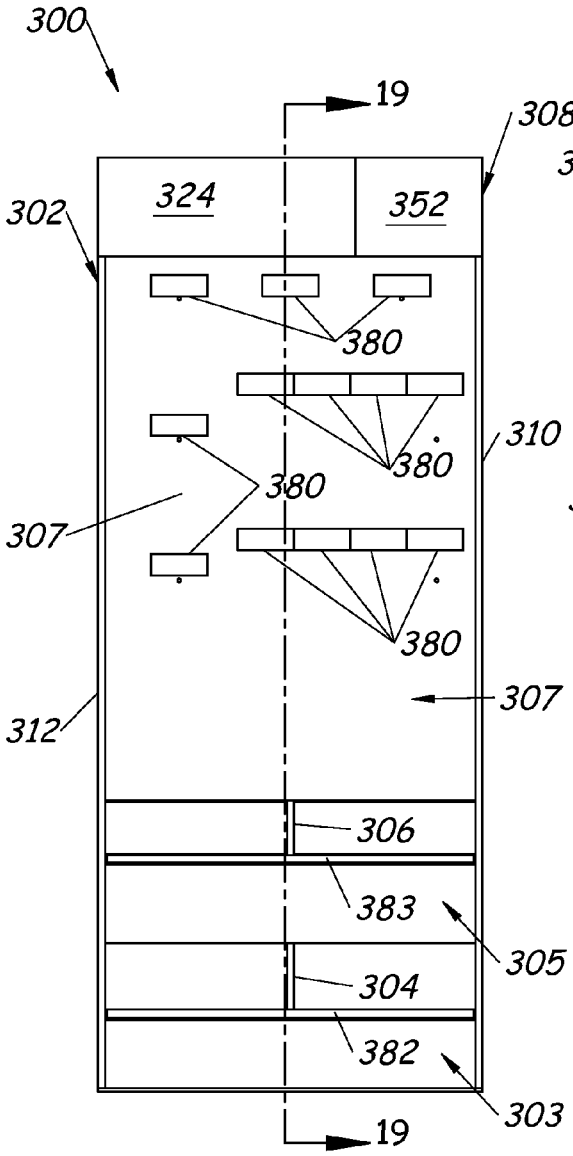
FIG. 26 is a front view of the display fixture illustrated in FIG. 25.
Figure 27:
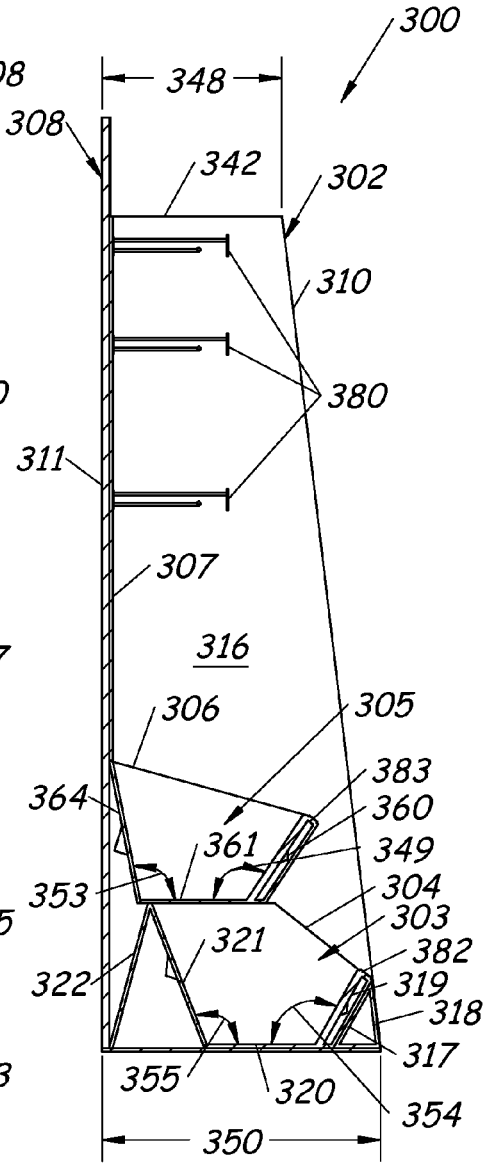
FIG. 27 is a section view of the display fixture illustrated in FIG. 25 taken along the line indicated in FIG. 26.

FIG. 25 is a perspective view of a display fixture 300 according to yet another embodiment. FIG. 26 is a front view of the display fixture 300 illustrated in FIG. 25, the back being unornamented. FIG. 27 is a section view of the display fixture 300 illustrated in FIG. 25 taken along the line indicated in FIG. 26. FIG. 28 is a top view of the display fixture 300 illustrated in FIG. 25, the bottom being unornamented. In one embodiment, display fixture 300 can display bin-type products as well as peg hook-type products. For example, display fixture 300 can display hats, socks, ties, purses and other clothing accessories on the peg hooks and can display shoes in the bins.

Figure 29:
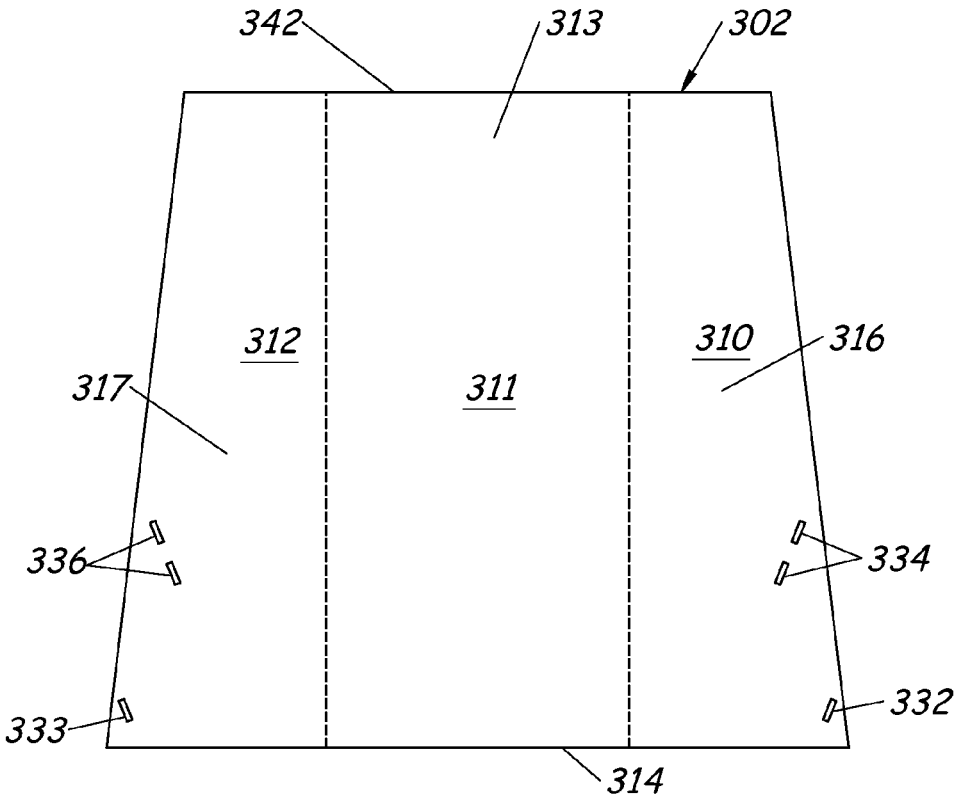
FIG. 29 is a plan view of a main body of the display fixture illustrated in FIG. 25 in a substantially planar configuration.
Figure 31:
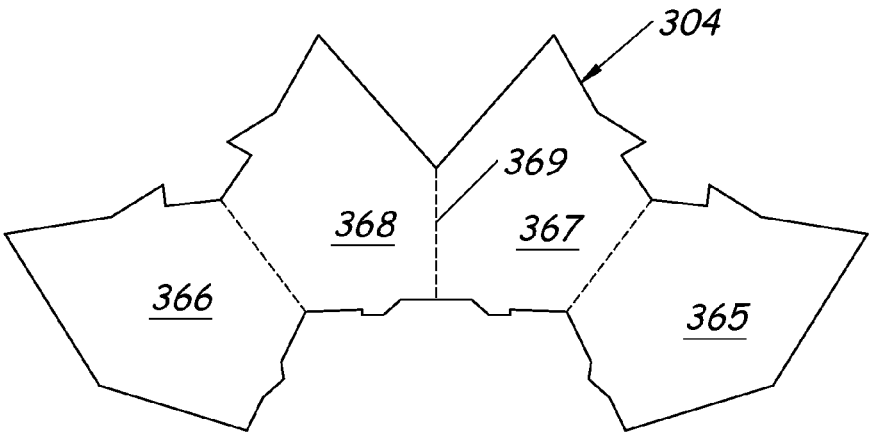
FIG. 31 is a plan view of a lower shelf divider of the display fixture illustrated in FIG. 25 in a substantially planar configuration.
Figure 30:
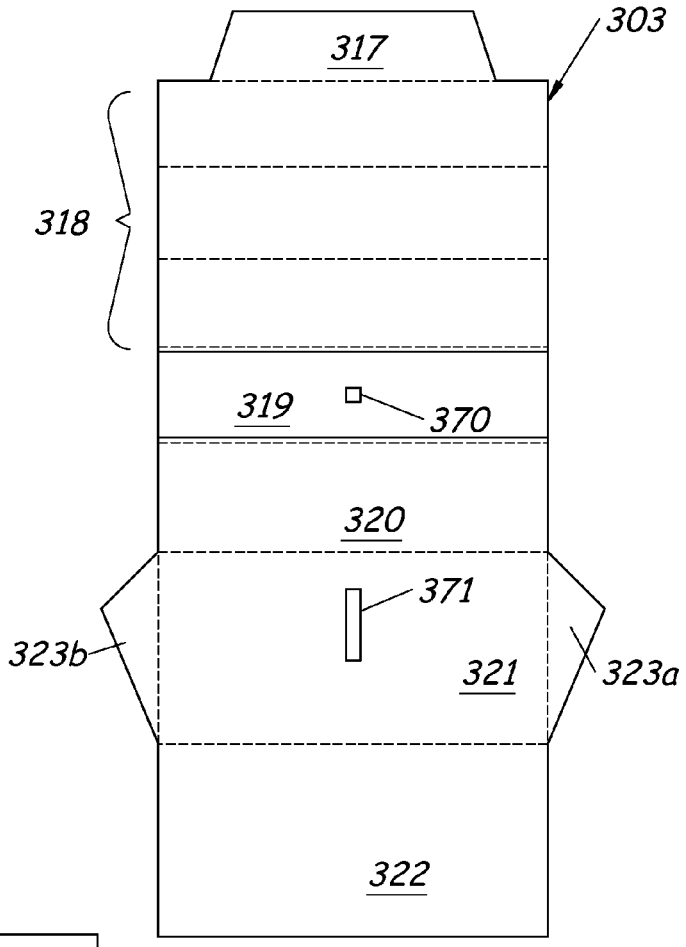
FIG. 30 is a plan view of a lower shelf of the display fixture illustrated in FIG. 25 in a substantially planar configuration.
Figure 32:
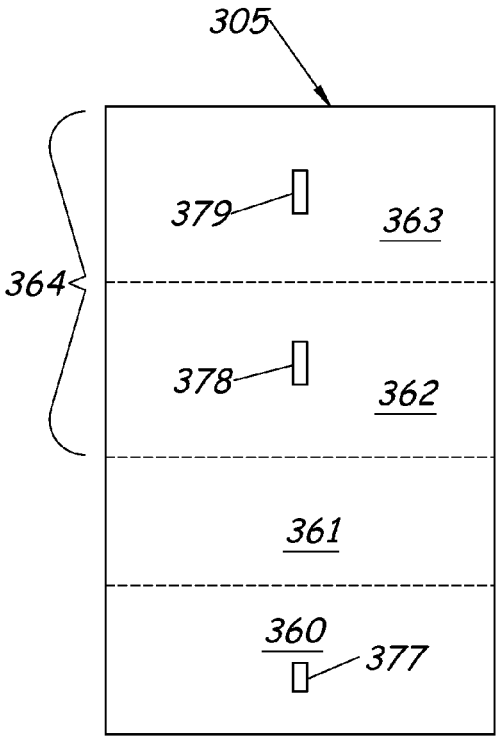
FIG. 32 is a plan view of an upper shelf of the display fixture illustrated in FIG. 25 in a substantially planar configuration.
Figure 33:
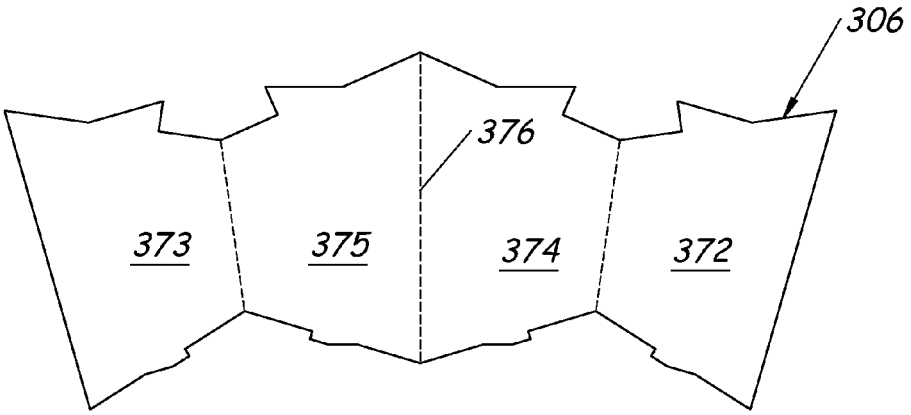
FIG. 33 is a plan view of an upper shelf divider of the display fixture illustrated in FIG. 25 in a substantially planar configuration.
Figure 34:
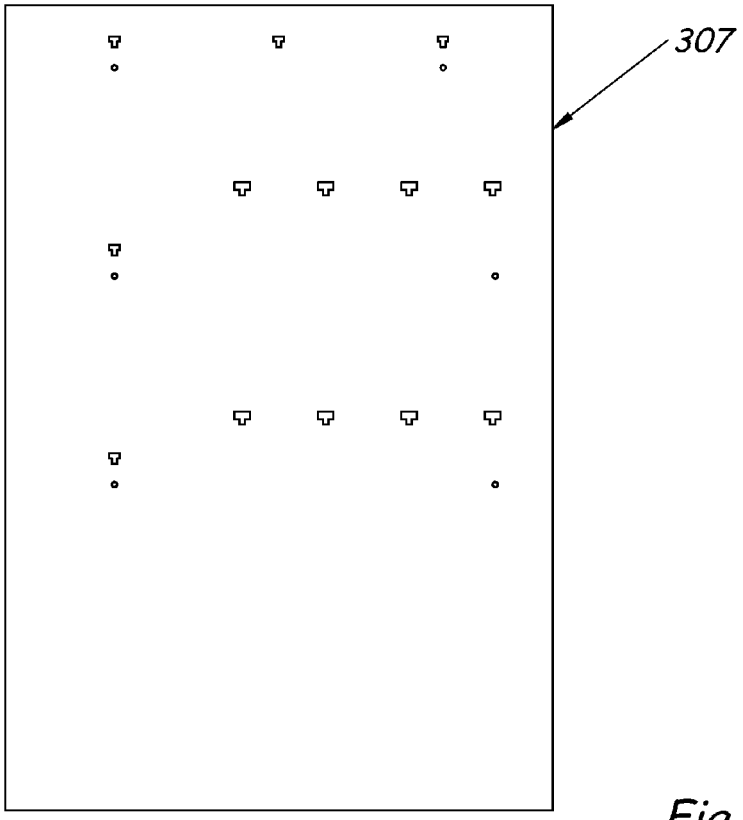
FIG. 34 is a plan view of a peg insert of the display fixture illustrated in FIG. 25 in a substantially planar configuration.
Figure 35:
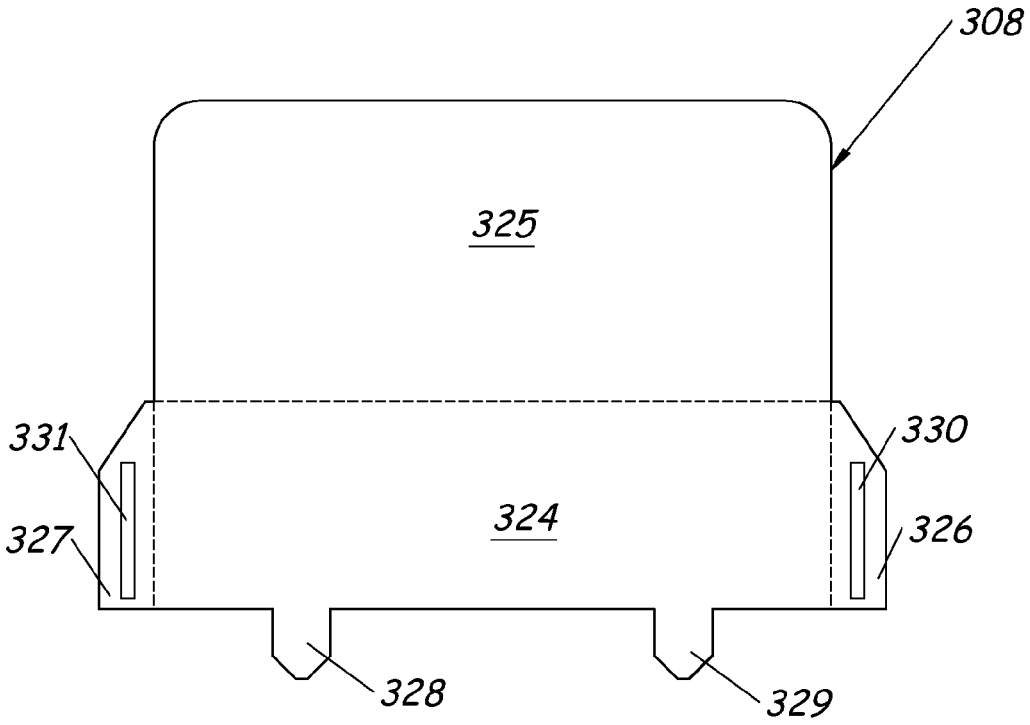
FIG. 35 is an enlarged plan view of a header of the display fixture illustrated in FIG. 25 in a substantially planar configuration.

Each component of display fixture 300 is shipped to a retail store flat or in a substantially planar configuration and is lightweight, inexpensive, and recyclable. For example, FIG. 29 illustrates a plan view of a main body or upright component 302 in a substantially planar configuration, FIG. 30 illustrates a plan view of a lower shelf 303 in a substantially planar configuration, FIG. 31 illustrates a plan view of a lower shelf divider 304 in a substantially planar configuration, FIG. 32 illustrates a plan view of an upper shelf 305 in a substantially planar configuration, FIG. 33 illustrates an upper shelf divider 306 in a substantially planar configuration, FIG. 34 illustrates a plan view of a peg insert 307 in a substantially planar configuration and FIG. 35 illustrates a plan view of a header 308 in a substantially planar configuration. Main body or upright component 302, lower shelf 303, lower shelf divider 304, upper shelf 305, upper shelf divider 306, peg insert 307 and header 308 are all parts of display fixture 300 that are shipped to a retail store flat for later assembly. In light of the substantially planar configurations, in one embodiment, display fixture 300 is a temporary display fixture that can be used during a particular shopping season and then easily deconstructed for disposal. For example, main body 302, lower shelf 303, lower shelf divider 304, upper shelf 305, upper shelf divider 306, peg insert 307 and header 308 of display fixture 100 can be made of corrugated cardboard. In FIGS. 29-35, all solid lines represent free edges while all dashed lines represent scores or folds.

As illustrated in FIG. 29 and in one embodiment, main body 302 includes three panels or sections coupled together by scores or folds including a right side panel or section 310, a center panel or section 311 and a left side panel or section 312. In another embodiment, main body 302 including right side panel 310, center panel 311 and left side panel 312 can be three separate panels that form main body 302. Each of the three panels or sections including right side panel 310, center panel 311 and left side panel 312 have interior surfaces 316, 313 and 317, respectively. Right side panel 310 and left side panel 312 include an arrangement of clips 332, 333, 334 and 336 that will couple other components of display fixture 300 to main body 302. To erect main body 302 from the substantially planar configuration illustrated in FIG. 29, main body 302 is stood up on its bottom edge 314 and right side panel 310 and left side panel 312 are folded inwardly such that inner facing surface 316 of right side panel or section 310 faces inner facing surface 317 of left side wall or section 312 and inner facing surface 313 of center panel or section 311 faces forward.

As illustrated in the substantially planar configuration of FIG. 30, lower shelf 303 includes a front flap 317, a front panel 318 coupled to front flap 317 by a score, a step panel 319 coupled to front panel 318 by a score, a bottom panel 320 coupled to step panel 319 by a score, a top panel 321 coupled to bottom panel 320 by a score, a back panel 322 coupled to top panel 321 by a score and a pair of side flaps 323*a* and 323*b* coupled to top panel 321 by scores. From its substantially planar configuration, further assembly is needed to configure lower shelf 303 into the usable configuration illustrated in FIGS. 25-28. In particular, front flap 317 and front panel 318 are folded four times along scores and then up and over onto step panel 319. Folded front flap 317 and front panel 318 are secured to step panel 319 with an adhesive strip. Side flaps 323*a* and 323*b* are folded up and back panel 322 is also folded up.

As illustrated in the substantially planar configuration of FIG. 32, upper shelf 305 includes a front panel 360, a bottom panel 361 coupled to front panel 360 by a score and a back panel 364 coupled to bottom panel 361 by a score and having a lower back panel 362 and an upper back panel 363 coupled to each other by a score. From its substantially planar configuration, further assembly is needed to configure upper shelf 305 into the usable configuration illustrated in FIGS. 25-28. In particular, upper back panel 363 is folded up and completely over lower back panel 362.

As illustrated in the substantially planar configuration of FIG. 35, header 308 includes a front panel 324, a back panel 325 coupled to front panel 324 by a score or fold, a right side flap 326 coupled to front panel 324 by a score or fold, a left side flap 327 coupled to front panel 324 by a score or fold and a pair of downward depending tabs 328 and 329 extending from an edge of front panel 324 that is opposite the score or fold that connects back panel 325 to front panel 324. Right side flap 326 includes an adhesive strip 330 having a backing and left side flap 327 also includes an adhesive strip 331 having a backing. From its substantially planar configuration, further assembly is needed to configure header 308 into the usable configuration illustrated in FIGS. 25-28. In particular, back panel 325 is folded over the interior side of front panel 324. Backings on the adhesive strips 330 and 331 are removed and right side flap 326 and left side flap 327 are folded over the exterior side of back panel 325 and secured with adhesive 330 and 331. Although not illustrated in FIG. 35, a front facing surface of front panel 324 can include indicia.

To assemble display fixture 300, lower shelf 303 is aligned and inserted into front clips 332 and 333 (FIG. 29) and therefore is located between right side panel 310 and left side panel 312 near bottom edge 314 of main body 302. Lower shelf 303 is pushed down until bottom panel 320 and an edge of back panel 322 sit on the floor. In this way, folded front flap 317, front panel 318 and step panel 319 are located at the front of main body 302, bottom panel 320 defines the bottom of lower shelf 303, top panel 321 defines a front rear of lower shelf 303 and back panel 322 defines a back rear of lower shelf 303. Side flaps 365 and 366 of lower shelf divider 304 (FIG. 31) are folded completely over onto base panels 367 and 368 and lower shelf divider 304 is folded in half at score 369. Lower shelf divider 304 is then inserted into slots 370 and 371 (FIG. 30) of lower shelf 303 to divide lower shelf 303 into bins. The assembly of lower shelf 303 is illustrated in detail in the section view illustrated in FIG. 27.

Next, upper shelf 305 is aligned and inserted into clips 334 and 336 and therefore is located between right side panel 310 and left side panel 312 of main body 302. Upper shelf 305 is pushed down until bottom panel 361 engages with a top of lower shelf divider 304 and the fold between top panel 321 and back panel 322. In this way, folded back panel 364 defines a rear of upper shelf 305, bottom panel 361 defines a bottom of upper shelf 305 and front panel 360 defines a front of upper shelf 305. Side flaps 372 and 373 of upper shelf divider 306 (FIG. 33) are folded completely over onto base panels 374 and 375 and upper shelf divider 306 is folded in half at score 376. Upper shelf divider 306 is then inserted into slots 377, 378 and 379 (FIG. 32) of upper shelf 305 to divide upper shelf 305 into bins. The assembly of upper shelf 305 is illustrated in detail in FIG. 27.

Still further, to finish assembling display fixture 300, peg insert 307 is mounted to interior surface 313 of center panel 311 of main body 302 and above shelves 303 and 305 using fasteners. In addition, the pair of downward depending tabs 328 and 329 of header 308 are inserted into slots located along a top edge 342 (FIG. 29) of main body 302. More particularly, the slots are located along top edge 342 of center panel 311. Header 308 is pressed down until assembled front panel 324 is flush with top edge 342 of main body 302. Peg hooks 380 are mounted to holes in peg insert 307.

With reference to FIGS. 25-28, fully assembled display fixture 300 includes main body 302 having substantially vertically oriented right side panel 310, center panel 311 and right side panel 312. Further, main body 302 includes front facing edges 344 and 345. Front facing edge 344 defines a free edge of right side panel 310 and front facing edge 345 defines a free edge of left side panel 312. Right side panel 310 and left side panel 312 taper along front facing edges 344 and 345 from bottom edge 314 to top edge 342 of main body 302. In other words, right side panel 310 and left side panel 312 include substantially similar top edge depths 348 (FIGS. 27 and 28) and substantially similar bottom edge depths 350 (FIGS. 27 and 28). Top edge depth 348 is less than bottom edge depth 350. Fully assembled display fixture 300 includes lower and upper shelves 303 and 305. Lower shelf 303 is coupled to main body 302 using clips 332 and 333 located on right side panel 310 and left side panel 312 and is additionally supported by the floor. Upper shelf 305 is coupled to main body 302 using clips 334 and 336 located on right side panel 310 and left side panel 312 and is additionally supported by lower shelf 303. The bottoms of shelves 303 and 305 are defined by panels 320 and 361 and are oriented substantially parallel with top edge 342 and bottom edge 314 of main body 302. The fronts of shelves 303 and 305 are defined by panels 319 and 360. The backs of shelves 303 and 305 are defined by panels 321 and 364. The fronts of shelves 303 and 305 are oriented at angles to bottom panels 320 and 361 and the backs of shelves 303 and 360 are oriented at angles to bottom panels 320 and 362. More specifically, the front of shelf 303 is oriented at an angle 354 relative to the bottom of shelf 303, the back of shelf 303 is oriented at an angle 355 relative to the bottom of shelf 303, the front of shelf 305 is oriented at an angle 349 relative to the bottom of shelf 305 and the back of shelf 305 is oriented at an angle 353 relative to the bottom of shelf 305. Angles 349, 353, 354 and 355 are obtuse angles (i.e., angles greater than 90 degrees and less than 180 degrees). The fronts and the backs of shelves 303 and 305 provide more space at the top of shelves 303 and 305 than at the bottom of bins 303 and 305 so that shelves 303 and 305 can hold more merchandise, but also be oriented to the customer for viewing. Mounted to center panel 311 of main body 302 above shelves 303 and 305 is a peg insert 307 that includes holes for receiving peg hooks. Peg insert 307 provides space for displaying merchandise that can be hung for viewing. In this way, product being displayed on lower and upper shelves 303 and 305 can be easily viewed and accessed by a customer whose eye level and arm reach is closer to the peg hooks on peg insert 307.

The front facing surface of front panel 324 of header 308 includes a sign holder 352. Sign holder 352 is a pocket made of, for example, an extruded polymer and is configured to receive a sign or graphic. While display fixture 300 illustrates sign holder 352 being located across only a portion of the front facing surface of front panel 324, sign holder 352 can be large enough to extend across the entire exterior surface of front panel 324. In addition, front edges 382 and 383 of shelves 303 and 305 can include a label holder made of, for example, an extruded polymer and configured to receive at least one price label. Peg hooks 380 also can including a label holder for receiving at least one price label.

Figure 36:
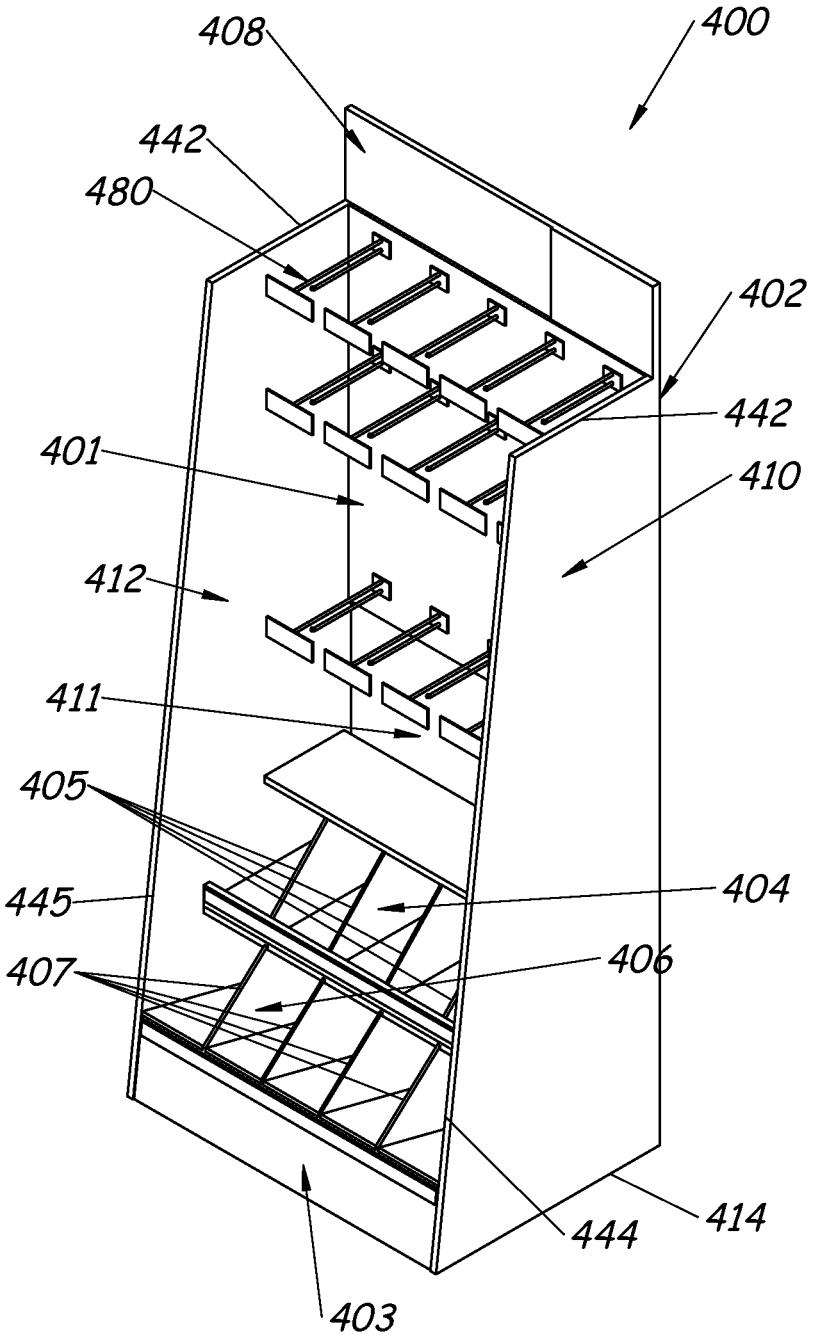
FIG. 36 is a perspective view of a display fixture according to yet another embodiment.
Figure 37:
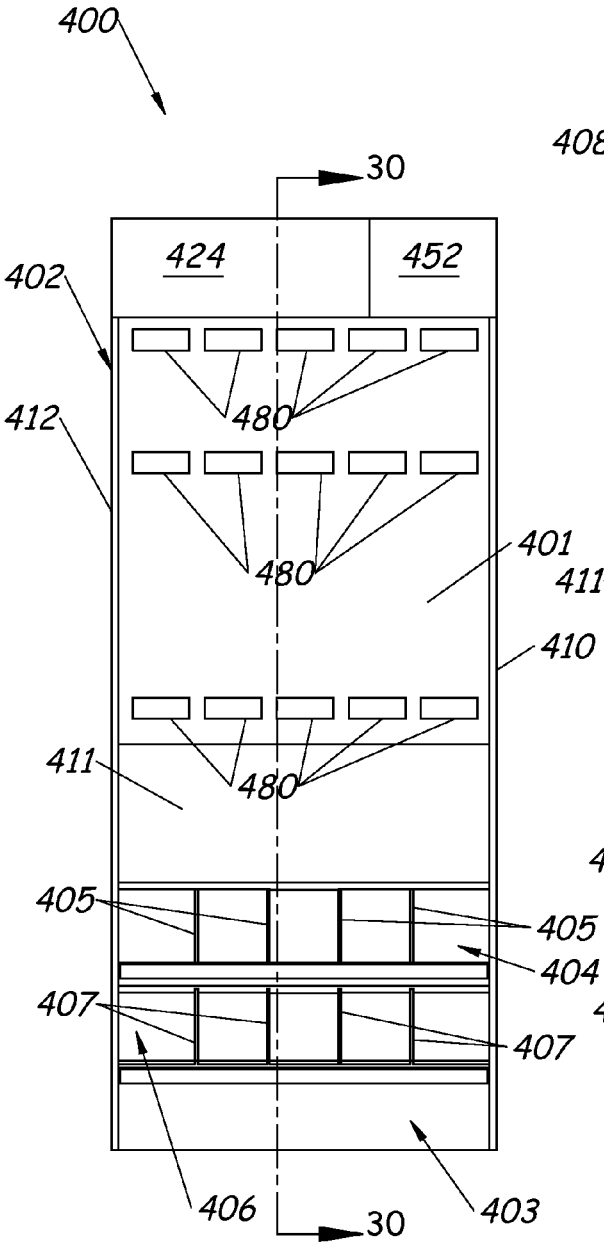
FIG. 37 is a front view of the display fixture illustrated in FIG. 36.
Figure 38:
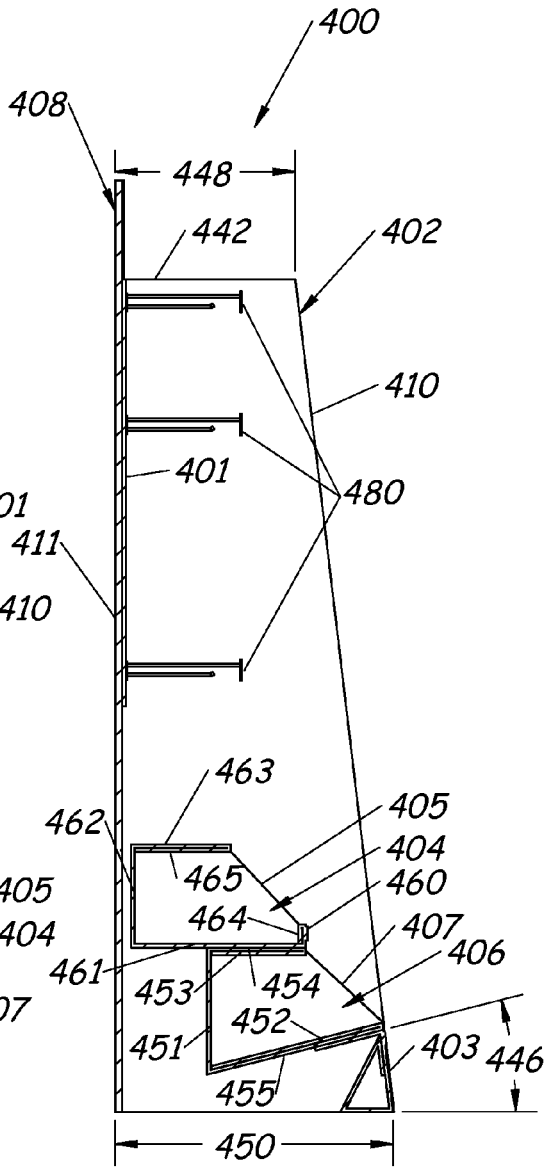
FIG. 38 is a section view of the display fixture illustrated in FIG. 36 taken along the line indicated in FIG. 37.
Figure 39:
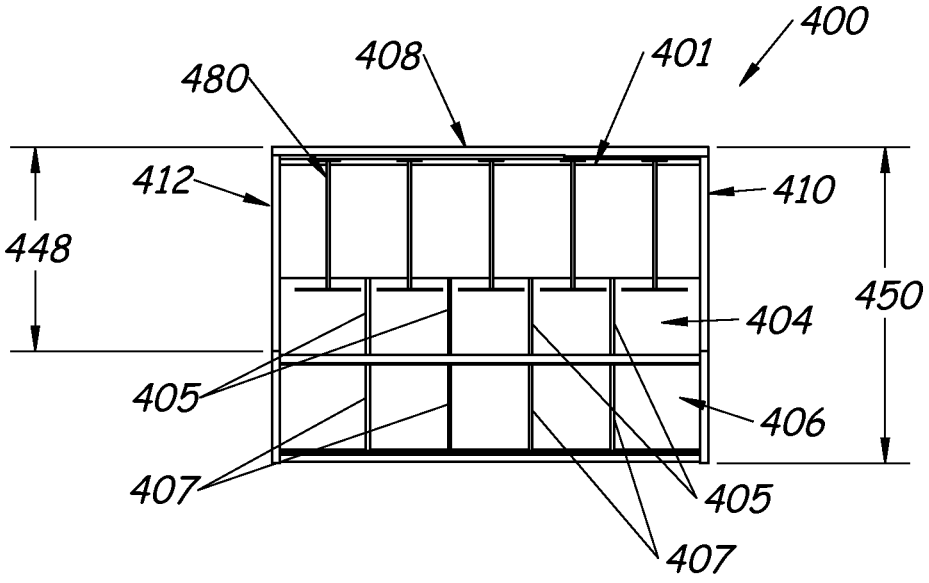
FIG. 39 is a top view of the display fixture illustrated in FIG. 36.

FIG. 36 is a perspective view of a display fixture 400 according to yet another embodiment. FIG. 37 is a front view of the display fixture 400 illustrated in FIG. 36, the back being unornamented. FIG. 38 is a section view of the display fixture 400 illustrated in FIG. 36 taken along the line indicated in FIG. 37. FIG. 39 is a top view of the display fixture 400 illustrated in FIG. 36, the bottom being unornamented. In one embodiment, display fixture 400, like display fixture 300, can display bin-type products as well as peg hook-type products. For example, display fixture 400 can display socks and other clothing accessories on the peg hooks and can display slippers in the bins.

Figure 42:
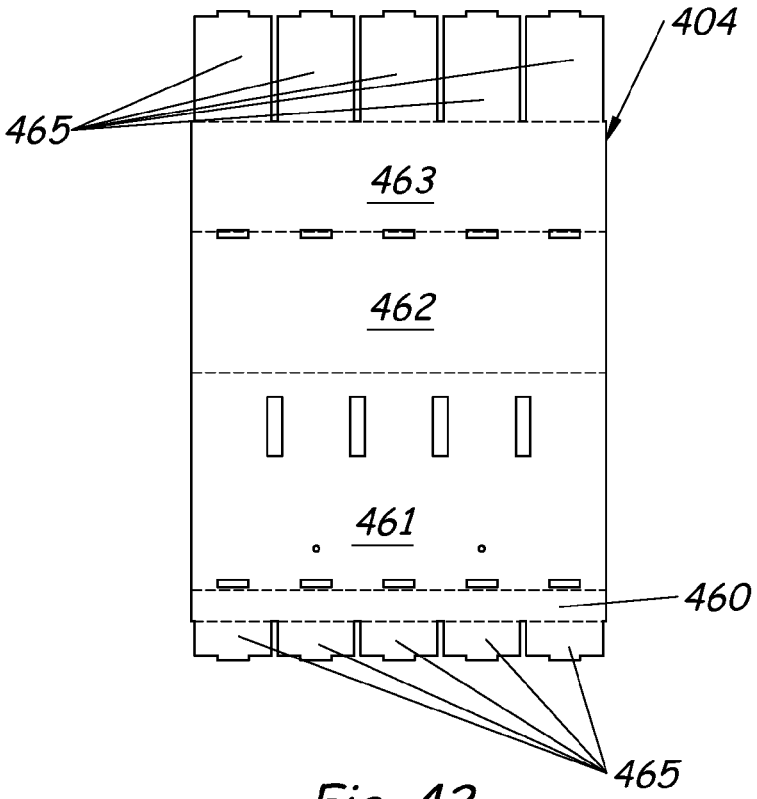
FIG. 42 is a plan view of an upper shelf of the display fixture illustrated in FIG. 36 in a substantially planar configuration.
Figure 43:
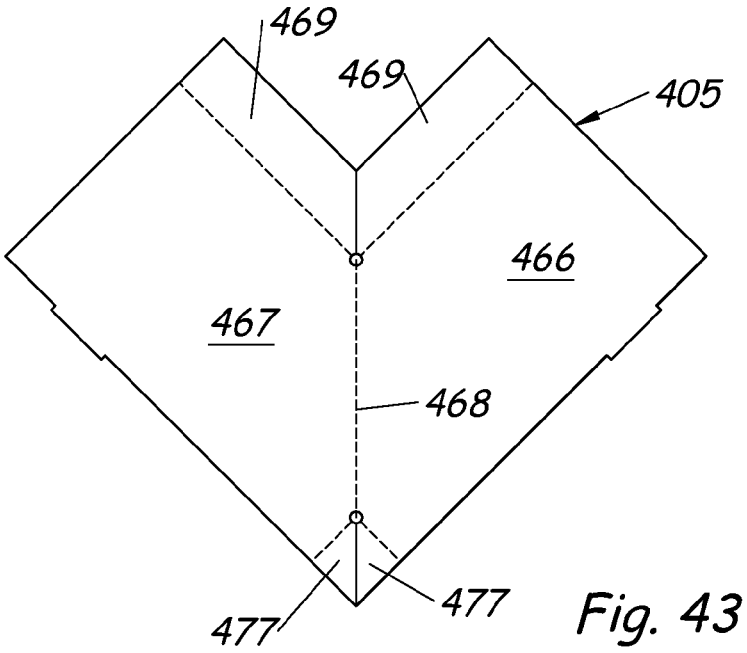
FIG. 43 is a plan view of one of a plurality of upper shelf dividers of the display fixture illustrated in FIG. 36 in a substantially planar configuration.
Figure 44:
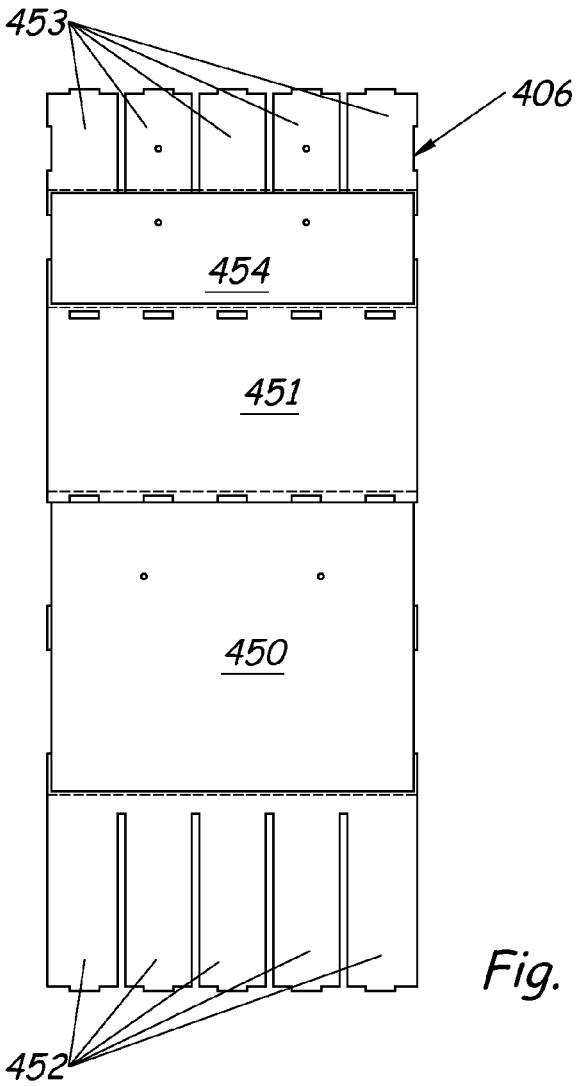
FIG. 44 is a plan view of a lower shelf of the display fixture illustrated in FIG. 36 in a substantially planar configuration.
Figure 45:
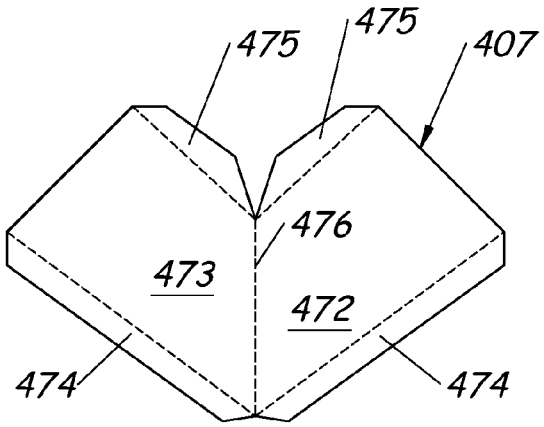
FIG. 45 is a plan view of one of a plurality of lower shelf dividers of the display fixture illustrated in FIG. 36 in a substantially planar configuration.
Figure 46:
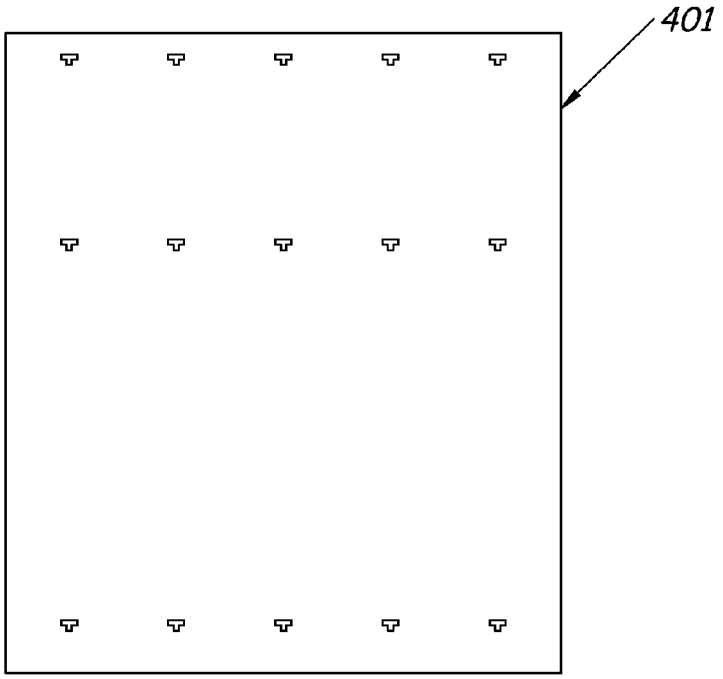
FIG. 46 is a plan view of a peg insert of the display fixture illustrated in FIG. 36 in a substantially planar configuration.
Figure 47:
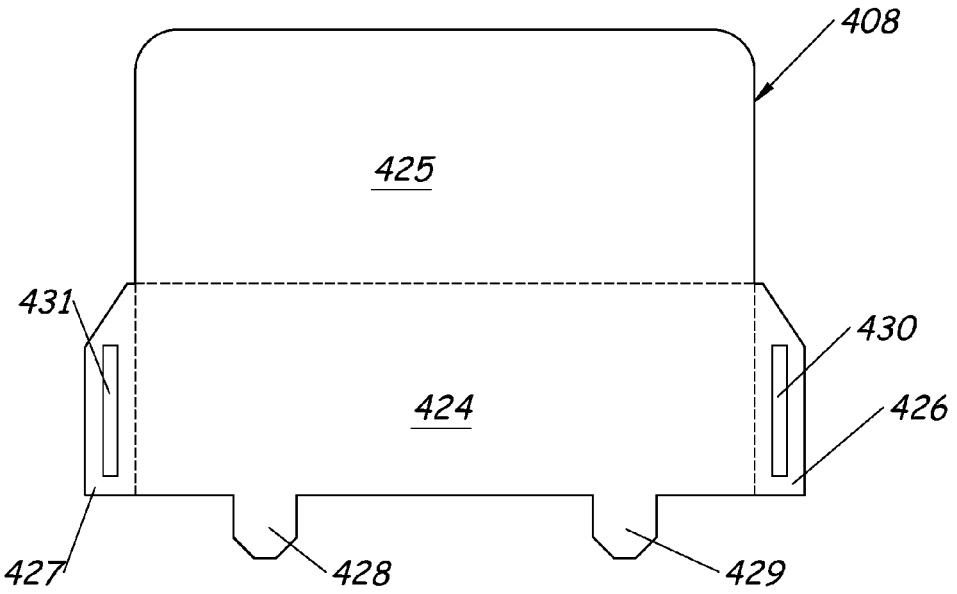
FIG. 47 is an enlarged plan view of a header of the display fixture illustrated in FIG. 36 in a substantially planar configuration.

Each component of display fixture 400 is shipped to a retail store flat or in a substantially planar configuration and is lightweight, inexpensive, and recyclable. For example, FIG. 40 illustrates a plan view of a main body or upright component 402 in a substantially planar configuration, FIG. 41 illustrates a plan view of a toe kick 403 in a substantially planar configuration, FIG. 42 illustrates a plan view of a upper shelf 404 in a substantially planar configuration, FIG. 43 illustrates a plan view of one of a plurality of upper shelf dividers 405 in a substantially planar configuration, FIG. 44 illustrates a plan view of a lower shelf 406 in a substantially planar configuration, FIG. 45 illustrates a plan view of one of a plurality of lower shelf dividers 407 in a substantially planar configuration, FIG. 46 illustrates a plan view of a peg insert 401 in a substantially planar configuration and FIG. 47 illustrates a plan view of a header 408 in a substantially planar configuration.

Main body or upright component 402, toe kick 403, upper shelf 404, upper shelf divider 405, lower shelf 406, lower shelf divider 407, peg insert 401 and header 408 are all parts of display fixture 400 that are shipped to a retail store flat for later assembly. In light of the substantially planar configurations, in one embodiment, display fixture 400 is a temporary display fixture that can be used during a particular shopping season and then easily deconstructed for disposal. For example, main body 402, toe kick 403, upper shelf 404, upper shelf divider 405, lower shelf 406, lower shelf divider 407, peg insert 401 and header 408 of display fixture 400 can be made of corrugated cardboard. In FIGS. 40-47, all solid lines represent free edges while all dashed lines represent scores or folds.

Figure 40:
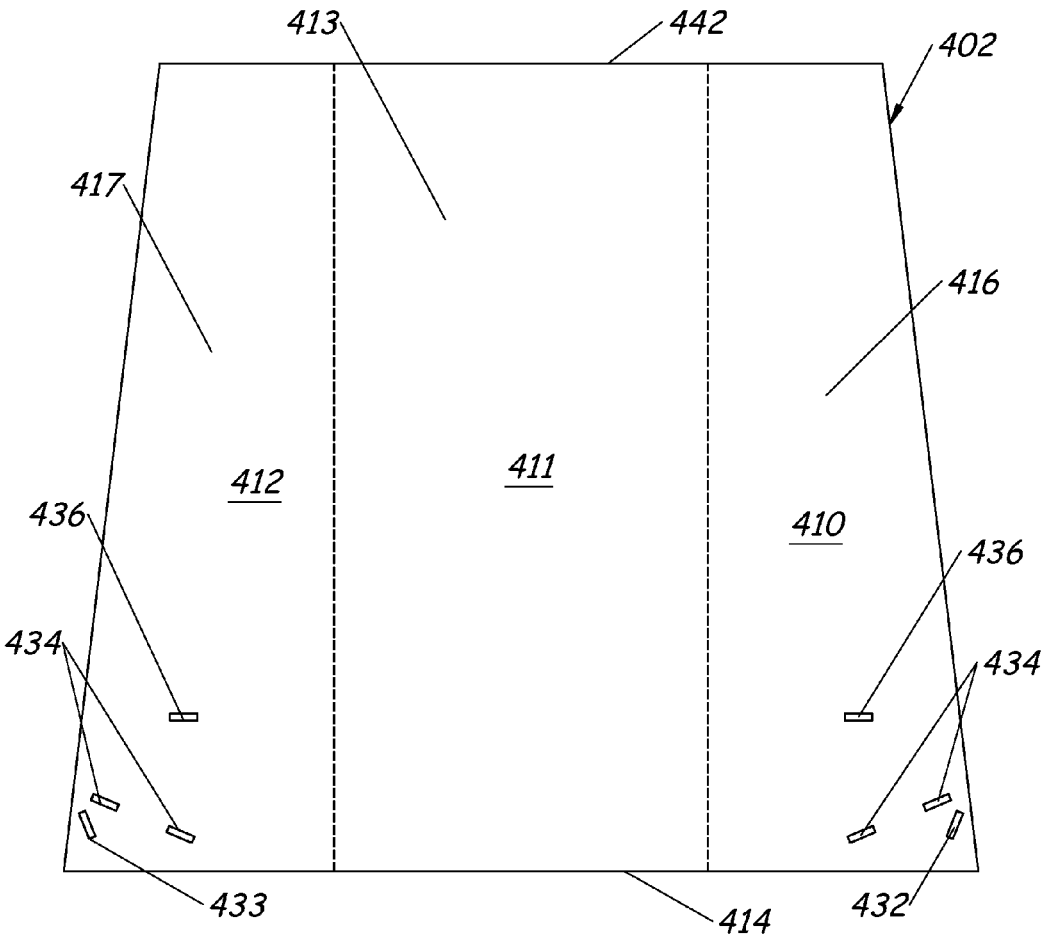
FIG. 40 is a plan view of a main body of the display fixture illustrated in FIG. 36 in a substantially planar configuration.

As illustrated in FIG. 40 and in one embodiment, main body 402 includes three panels or sections coupled together by scores or folds including a right side panel or section 410, a center panel or section 411 and a left side panel or section 412. In another embodiment, main body 402 including right side panel 410, center panel 411 and left side panel 412 can be three separate panels that form main body 402. Each of the three panels or sections including right side panel 410, center panel 411 and left side panel 412 have interior surfaces 416, 413 and 417, respectively. Right side panel 410 and left side panel 412 include an arrangement of clips 432, 433, 434 and 436 that will couple other components of display fixture 400 to main body 402. To erect main body 402 from the substantially planar configuration illustrated in FIG. 40, main body 402 is stood up on its bottom edge 414 and right side panel 410 and left side panel 412 are folded inwardly such that inner facing surface 416 of right side panel or section 410 faces inner facing surface 417 of left side panel or section 412 and inner facing surface 413 of center panel or section 411 faces forward.

Figure 41:
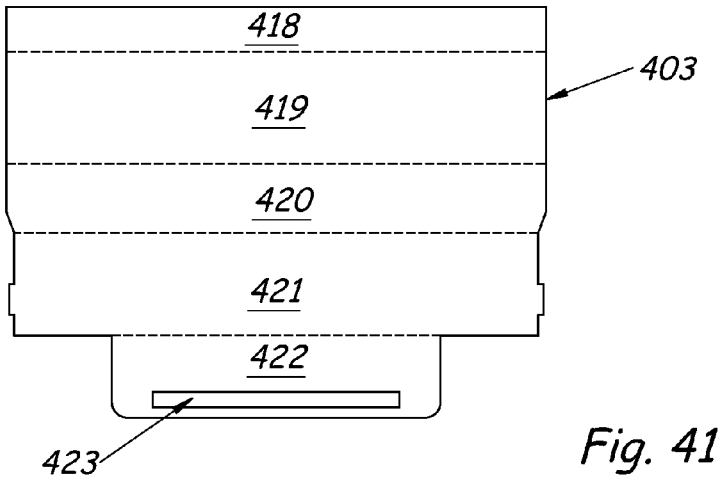
FIG. 41 is a plan view of a toe kick of the display fixture illustrated in FIG. 36 in a substantially planar configuration.

As illustrated in the substantially planar configuration of FIG. 41, toe kick 404 includes five panels coupled together by scores or folds including a top panel 418, a front panel 419, a bottom panel 420, a back panel 421 and an inside panel 422. Inside panel 422 includes an adhesive strip 423 having a backing. From its substantially planar configuration, further assembly is needed to configure toe kick 404 into the usable configuration illustrated in FIGS. 36-39. In particular, the backing on the adhesive strip 423 is removed and back panel 421 is folded up and over so that the inside panel 422 is secured to the interior of front panel 419 with adhesive 423. The assembly of toe kick 404 is illustrated in the section view illustrated in FIG. 38.

Lower shelf 406, as illustrated in FIG. 44, includes a bottom panel 452 coupled to a back panel 451 by a score or fold, a top panel 454 coupled to back panel 451 by a score or fold, a plurality of bottom flaps 455 that are coupled to bottom panel 452 by a score or fold and a plurality of top flaps 453 that are coupled to top panel 454 by a score or fold. A plurality of lower shelf dividers 407, of which one is illustrated in FIG. 45, includes two panels 472 and 473 coupled together by a score or fold 476. Each panel 472 and 473 includes a bottom flap 474 and a top flap 475. Upper shelf 404, as illustrated in FIG. 42, includes a front panel 460 coupled to a bottom panel 461 by a score or fold, a back panel 462 coupled to bottom panel 461 by a score or fold, a top panel 463 coupled to back panel 462 by a score or fold, a plurality of bottom flaps 464 coupled to front panel 460 by a score or fold and a plurality of top flaps 465 coupled to top panel 463 by a score or fold. A plurality of upper shelf dividers 405, of which one is illustrated in FIG. 43, include two panels 466 and 467 coupled together by a score or fold 468. Each panel 466 and 467 includes top flaps 469 and front flaps 477.

As illustrated in the substantially planar configuration of FIG. 47, header 408 includes a front panel 424, a back panel 425 coupled to front panel 424 by a score or fold, a right side flap 426 coupled to front panel 424 by a score or fold, a left side flap 427 coupled to front panel 424 by a score or fold and a pair of downward depending tabs 428 and 429 extending from an edge of front panel 424 that is opposite the score or fold that connects back panel 425 to front panel 424. Right side flap 426 includes an adhesive strip 430 having a backing and left side flap 427 also includes an adhesive strip 431 having a backing. From its substantially planar configuration, further assembly is needed to configure header 408 into the usable configuration illustrated in FIGS. 36-39. In particular, back panel 425 is folded over the interior side of front panel 424. Backings on the adhesive strips 430 and 431 are removed and right side flap 426 and left side flap 427 are folded over the exterior side of back panel 425 and secured with adhesive 430 and 431. Although not illustrated in FIG. 47, a front facing surface of front panel 424 can include indicia.

To assemble display fixture 400, first, assembled toe kick 403 is aligned and inserted into front clips 432 and 433 (FIG. 40) and therefore located between right side panel 410 and left side panel 412 near bottom edge 414 of main body 402. Then, back panel 451 and top panel 454 of lower shelf 406 (FIG. 44) are folded up relative to bottom panel 452 of lower shelf 406. Bottom panel 452 of lower shelf 406 is inserted into bottom clips 434 and therefore located between right side panel 410 and left side panel 412 of main body 402. An adhesive strip on toe kick 403 secures toe kick 403 to bottom panel 452 of lower shelf 406. After bottom panel 452 is secured to toe kick 403, a left bottom flap 455 of the plurality of bottom flaps 455 is folded in and locked to the top of bottom panel 452 by engaging a tab on a distal end of left bottom flap 455 with a corresponding slot that is adjacent bottom panel 452.

Each lower shelf divider 407 (FIG. 45) is folded in half at score 476 and bottom flaps 474 and top flaps 475 of divider 407 are folded out relative to panels 472 and 473 of divider 407. One of the bottom flaps 473 of divider 407 is slid under the left bottom flap 455 of lower shelf 406 and an adjacent bottom flap 455 of lower shelf 406 is folded on top of bottom flap 472 of divider 407 and locked to the top of bottom panel 452 of lower shelf 406 by engaging a tab on a distal end of the adjacent bottom flap 455 with a corresponding slot that is adjacent bottom panel 452. These steps are repeated for the remaining lower shelf dividers 407 and bottom flaps 452 of lower shelf 406 to thereby divide lower shelf 406 into a plurality of bins. Top panel 454 of lower shelf 406 is folded down on top flaps 475 of dividers 407 and into clips 436 (FIG. 40) of main body 402. Top flaps 453 of lower shelf 406 are folded underneath top panel 454 and locked to the bottom of top panel 454 by engaging tabs on distal ends of top flaps 453 with corresponding slots that are adjacent back panel 451. The assembled version of lower shelf 406 and lower shelf dividers 407 is illustrated in FIGS. 36-39.

Next, back panel 462 and top panel 463 of upper shelf 404 (FIG. 42) are folded up relative to front panel 460 and bottom panel 461 of upper shelf 404. Bottom panel 461 of upper shelf 404 is placed on top of top panel 454 of lower shelf 406 and secured together using fasteners. After bottom panel 461 of upper shelf 404 is secured to top panel 454 of lower shelf 406, each upper shelf divider 405 (FIG. 43) is folded in half at score 468 and top flaps 469 and front flaps 477 of each divider 407 is folded out relative to panels 466 and 467. Bottom tabs on each of the dividers 405 are inserted into corresponding substantially vertical slots in bottom panel 461 of upper shelf 404 to thereby divide upper shelf 404 into a plurality of bins. Top panel 463 of upper shelf 404 is folded down onto top flaps 469 of each divider 405 and top flaps 465 are folded underneath top panel 463 and distal tabs on top flaps 465 are locked into substantially horizontal slots in back panel 462. Front panel 460 is folded up to define a front of upper shelf 404 and bottom flaps 464 are folded in and distal tabs on bottom flaps 464 are locked into substantially horizontal slots in bottom panel 461 of upper shelf 404. The assembled version of upper shelf 404 and upper shelf dividers 405 is illustrated in FIGS. 36-39.

To finish the assembly of display fixture 400, peg insert 401 is mounted to interior surface 413 of center panel 411 of main body 402 and above shelves 404 and 406 using fasteners. In addition, the pair of downward depending tabs 428 and 429 of header 408 are inserted into slots located along a top edge 442 (FIG. 40) of main body 402. More particularly, the slots are located along top edge 442 of center panel 411. Header 408 is pressed down until assembled front panel 424 is flush with top edge 442 of main body 402. Peg hooks 480 are mounted to holes in peg insert 401.

With reference to FIGS. 36-39, fully assembled display fixture 400 includes main body 402 having substantially vertically oriented right side panel 410, center panel 411 and left side panel 412. Further, main body 402 includes front facing edges 444 and 445. Front facing edge 444 defines a free edge of right side panel 410 and front facing edge 445 defines a free edge of left side panel 412. Right side panel 410 and left side panel 412 taper along front facing edges 444 and 445 from bottom edge 414 to top edge 442 of main body 402. In other words, right side panel 410 and left side panel 412 include substantially similar top edge depths 448 (FIGS. 38 and 39) and substantially similar bottom edge depths 450 (FIGS. 38 and 39). Top edge depth 448 is less than bottom edge depth 450. In this way, product being displayed on lower and upper shelves 404 and 406 can be easily view. Fully assembled display fixture 400 includes lower and upper shelves 404 and 406. Lower shelf 404 is coupled to main body 402 using clips 432 and 433 and is secured to toe kick 403 and additionally supported by the floor. Upper shelf 404 is coupled to and supported by top panel 454 of lower shelf 406 using fasteners. While the bottom of upper shelf 404 as defined by bottom panel 461 is oriented substantially parallel with top edge 442 and bottom edge 414 of main body 402, the bottom of lower shelf 406 as defined by bottom panel 452 is oriented at an angle 446 with respect to bottom edge 414. Angle 446 is an acute angle (i.e., an angle less than 90 degrees and greater than zero degrees) that provides a viewing angle to the customer for looking down at the items located on lower shelf 406. Mounted to center panel 411 of main body 402 above shelves 404 and 406 is a peg insert 401 that includes holes for receiving peg hooks 380. Peg insert 401 provides space for displaying merchandise that can be hung for viewing. In this way, product being displayed on lower and upper shelves 406 and 404 can be easily viewed and accessed by a customer whose eye level and arm reach is closer to the peg hooks on peg insert 401.

The front facing surface of front panel 424 of header 408 includes a sign holder 452. Sign holder 452 is a pocket made of, for example, an extruded polymer and is configured to receive a sign or graphic. While display fixture 400 illustrates sign holder 452 being located across only a portion of the front facing surface of front panel 424, sign holder 452 can be large enough to extend across the entire front facing surface of front panel 424. In addition, a front facing surface of front panel 460 of upper shelf 404 and front facing surface of toe kick 403 can include label holders made of, for example, an extruded polymer and configured to receive at least one price label. In addition, peg hooks 480 can include a label holder for receiving at least one price label.

Figure 48:
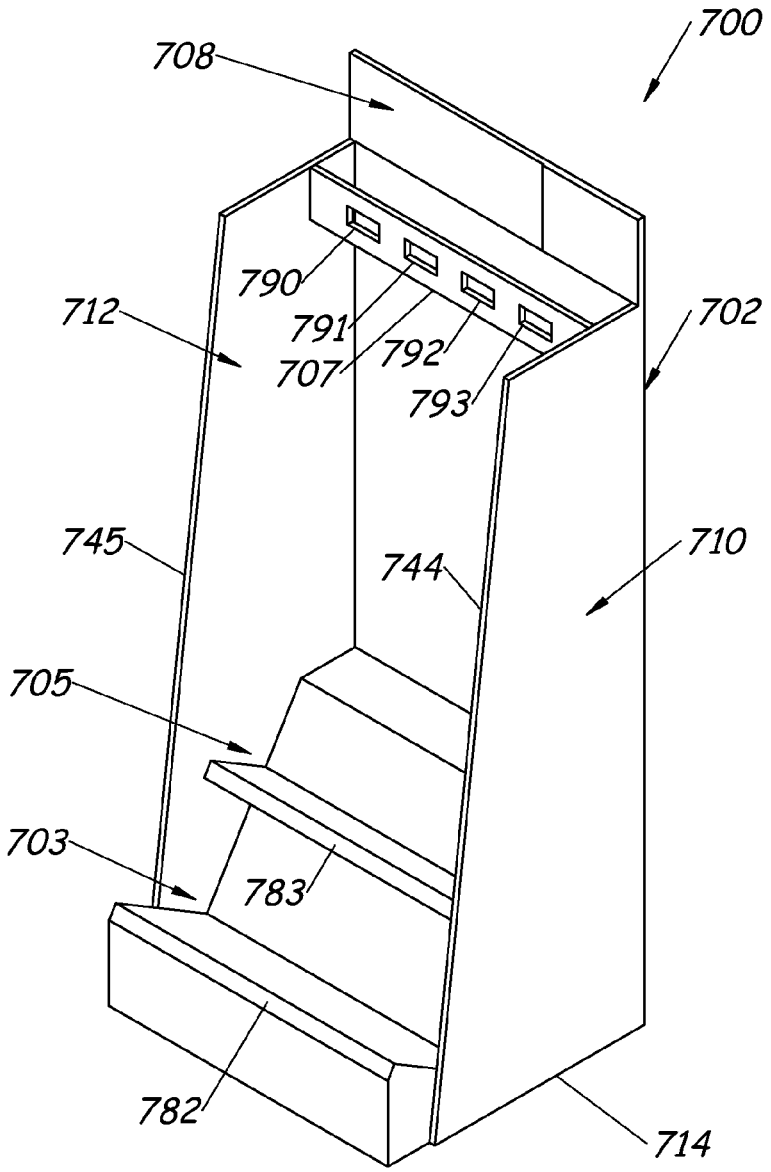
FIG. 48 is a perspective view of a display fixture according to yet another embodiment.
Figure 49:
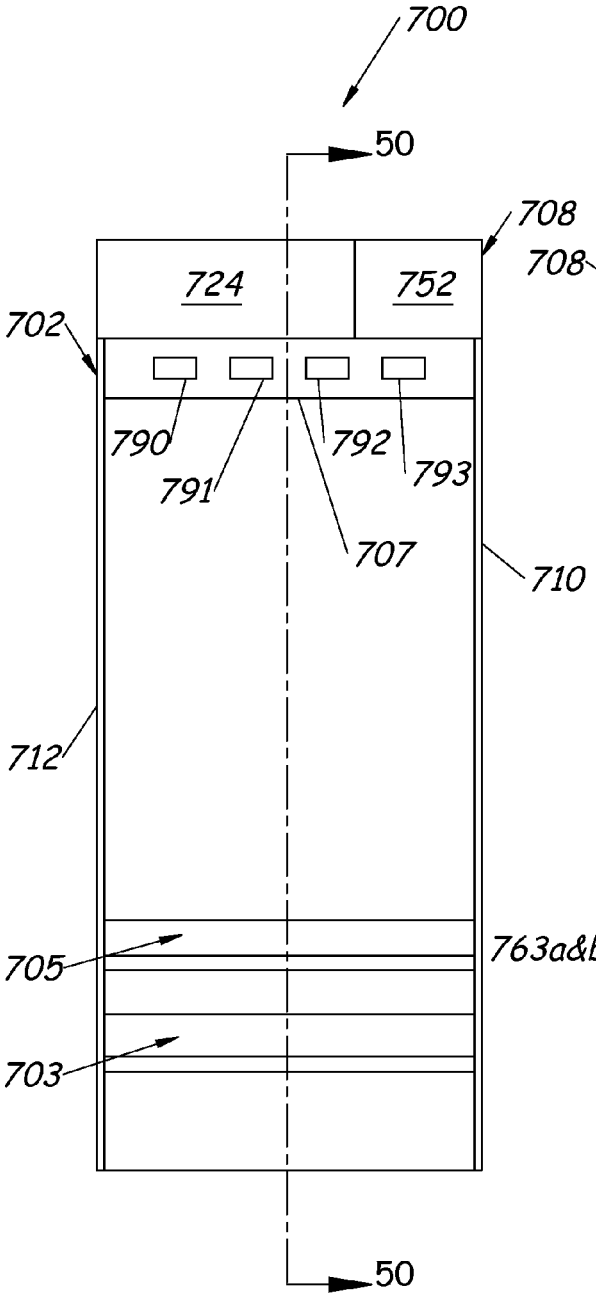
FIG. 49 is a front view of the display fixture illustrated in FIG. 48.
Figure 50:
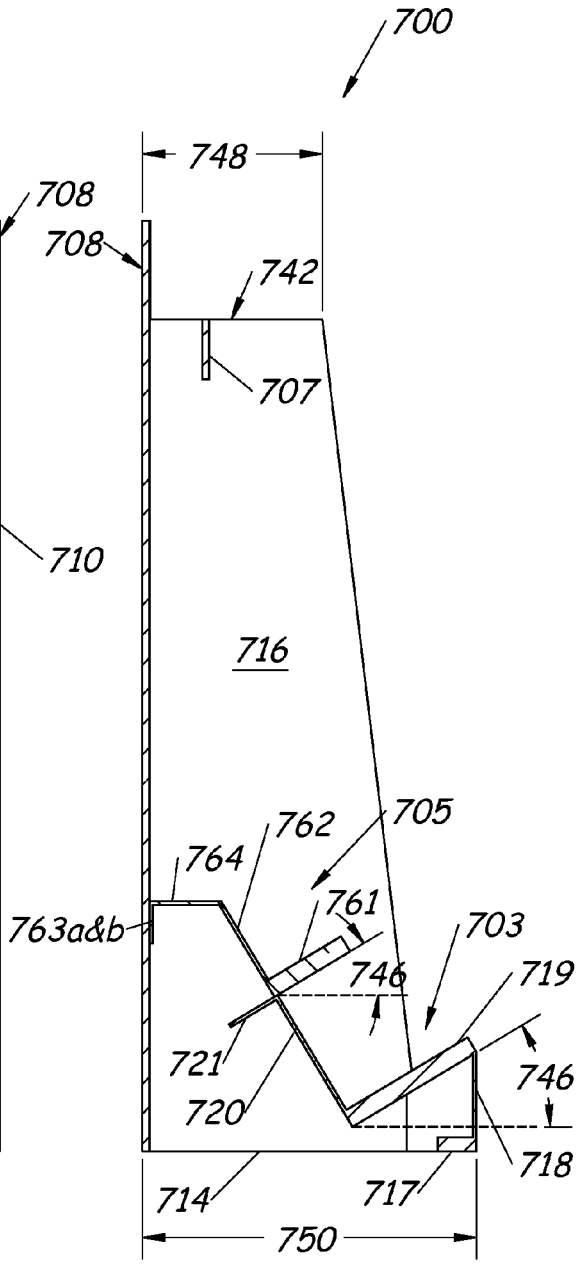
FIG. 50 is a section view of the display fixture illustrated in FIG. 48 taken along the line indicated in FIG. 49.
Figure 51:
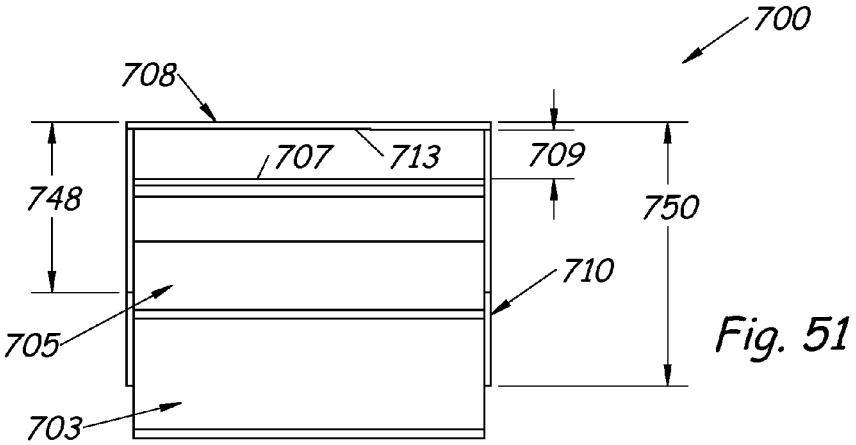
FIG. 51 is a top view of the display fixture illustrated in FIG. 48.

FIG. 48 is a perspective view of a display fixture 700 according to yet another embodiment. FIG. 49 is a front view of the display fixture 700 illustrated in FIG. 48, the back being unornamented. FIG. 50 is a section view of the display fixture 700 illustrated in FIG. 48 taken along the line indicated in FIG. 49. FIG. 51 is a top view of the display fixture 700 illustrated in FIG. 48, the bottom being unornamented. In one embodiment, display fixture 700 can display shelf-type products as well as hanging-type products. For example, display fixture 700 can display garment that are hung on hangers on a cross-bar component 707 and can display packaged garments on shelves 703 and 705.

Figure 52:
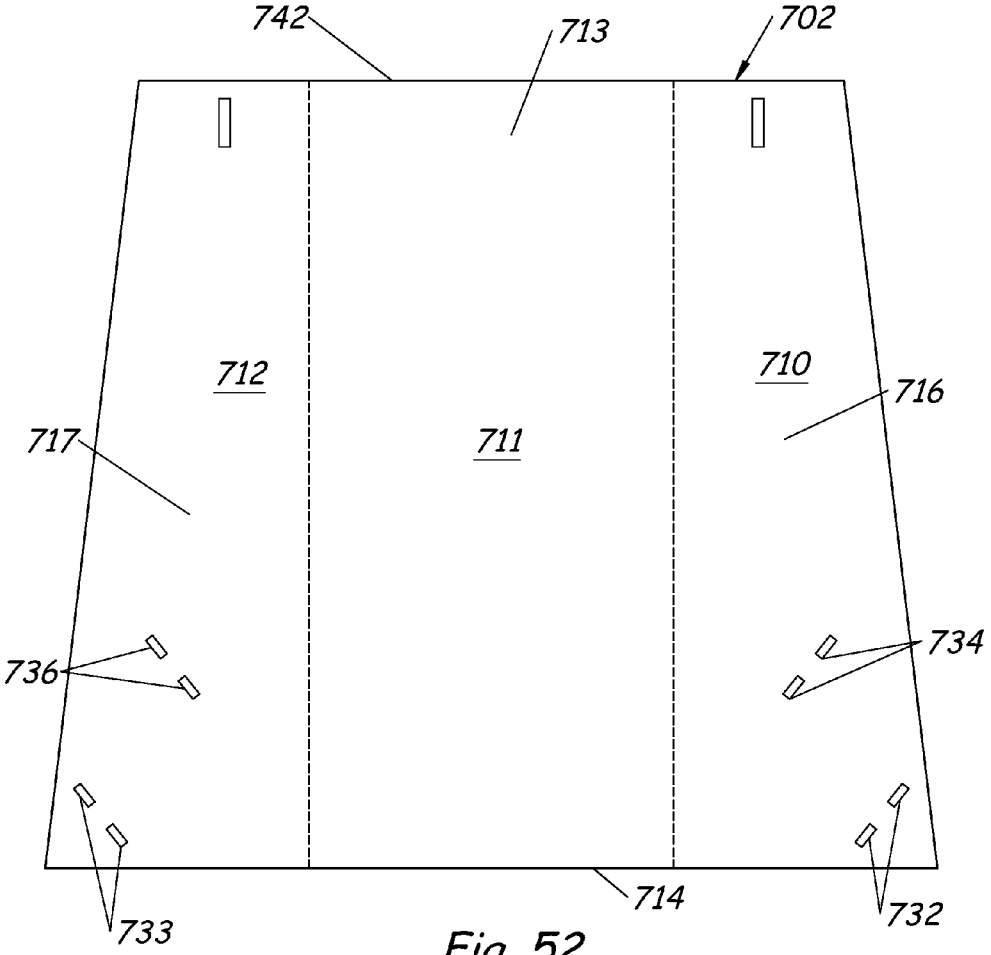
FIG. 52 is a plan view of a main body of the display fixture illustrated in FIG. 48 in a substantially planar configuration.
Figure 53A:
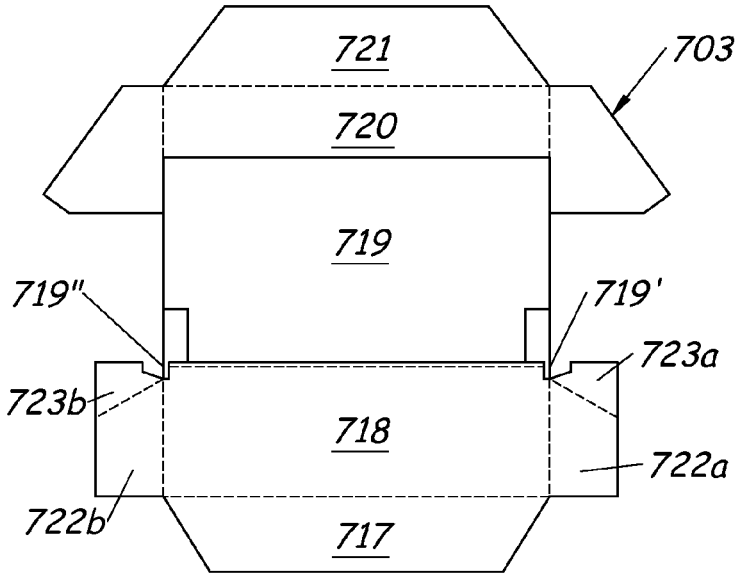
FIGS. 53A and 53B are plan views of a lower shelf of the display fixture illustrated in FIG. 48 in a substantially planar configuration.
Figure 53B:
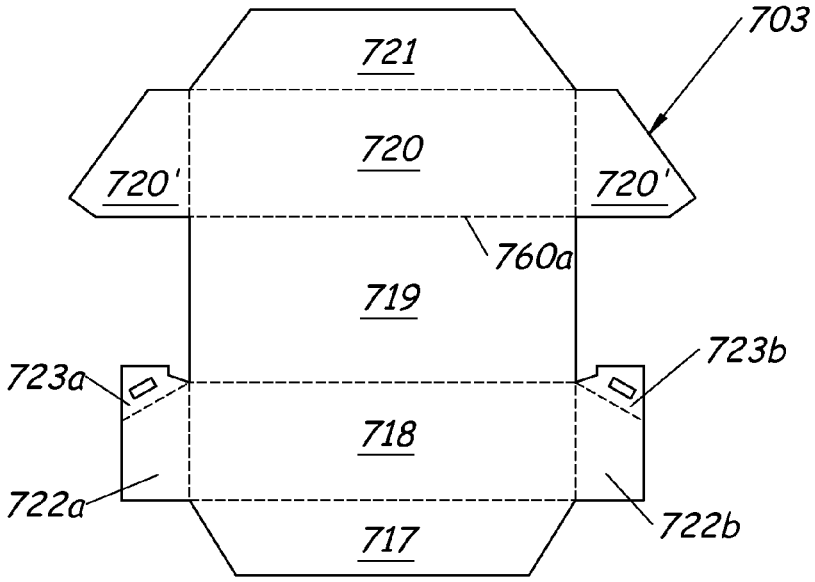
Figure 54:
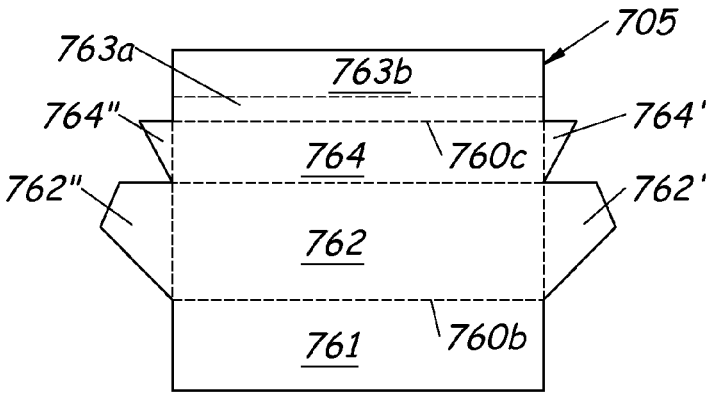
FIG. 54 is a plan view of an upper shelf of the display fixture illustrated in FIG. 48 in a substantially planar configuration.
Figure 55:
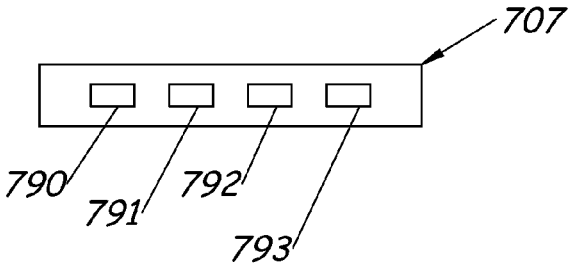
FIG. 55 is a plan view of a cross-bar component of the display fixture illustrated in FIG. 48 in a substantially planar configuration.
Figure 56:
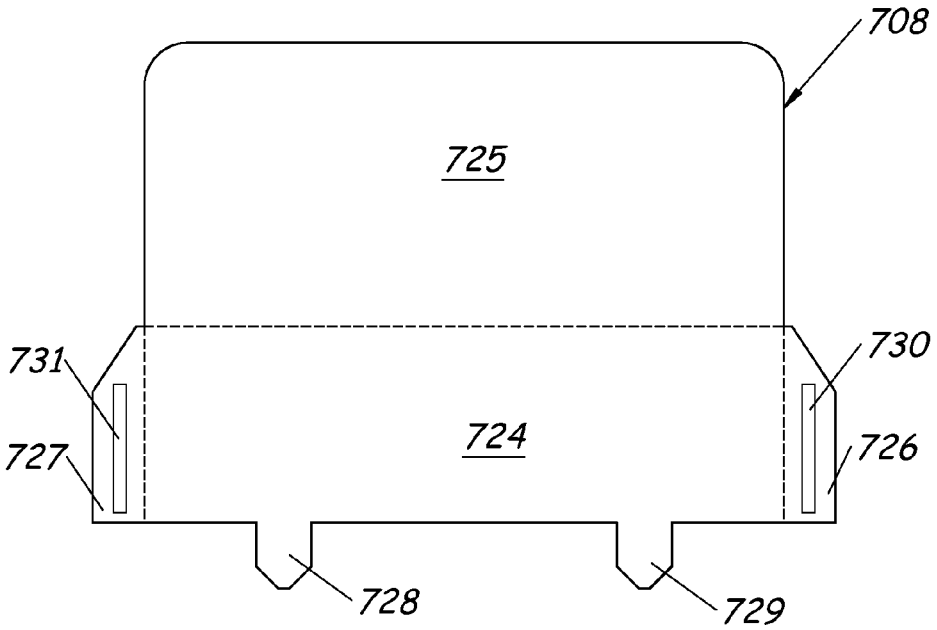
FIG. 56 is an enlarged plan view of a header of the display fixture illustrated in FIG. 48 in a substantially planar configuration.

Each component of display fixture 700 is shipped to a retail store flat or in a substantially planar configuration and is lightweight, inexpensive, and recyclable. For example, FIG. 52 illustrates a plan view of a main body or upright component 702 in a substantially planar configuration, FIG. 53A illustrates a plan view of an inner surface of lower shelf 703 in a substantially planar configuration, FIG. 53B illustrates a plan view of an outer surface of lower shelf 703 in the substantially planar configuration, FIG. 54 illustrates a plan view of upper shelf 705 in a substantially planar configuration, FIG. 55 illustrates cross-bar component divider 707 in a substantially planar configuration, and FIG. 56 illustrates an enlarged plan view of a header 708 in a substantially planar configuration. Main body or upright component 702, lower shelf 703, upper shelf 705, cross-bar component 707 and header 708 are all parts of display fixture 700 that are shipped to a retail store flat for later assembly. In light of the substantially planar configurations, in one embodiment, display fixture 700 is a temporary display fixture that can be used during a particular shopping season and then easily deconstructed for disposal. For example, main body 702, lower shelf 703, upper shelf 705, cross-bar component 707 and header 708 of display fixture 700 can be made of corrugated cardboard. In FIGS. 52-56, all solid lines represent free edges while all dashed lines represent scores or folds.

As illustrated in FIG. 52 and in one embodiment, main body 702 includes three panels or sections coupled together by scores or folds including a right side panel or section 710, a center panel or section 711 and a left side panel or section 712. In another embodiment, main body 702 including right side panel 710, center panel 711 and left side panel 712 can be three separate panels that form main body 702. Each of the three panels or sections including right side panel 710, center panel 711 and left side panel 712 have interior surfaces 716, 713 and 717, respectively. Right side panel 710 and left side panel 712 include an arrangement of clips 732, 733, 734 and 736 that will couple other components of display fixture 700 to main body 702. To erect main body 702 from the substantially planar configuration illustrated in FIG. 52, main body 702 is stood up on its bottom edge 714 and right side panel 710 and left side panel 712 are folded inwardly such that inner facing surface 716 of right side panel or section 710 faces inner facing surface 717 of left side wall or section 712 and inner facing surface 713 of center panel or section 711 faces forward.

As illustrated in the substantially planar configuration of FIGS. 53A and 53B, lower shelf 703 includes a bottom 717, a front 718 coupled to bottom 717 by a score, a shelf panel 719 coupled to front 718 by a score, a back 720 coupled to shelf panel 719 by a score, a top panel 721 coupled to back 720 by a score, a pair of side support panels 722*a* and 722*b* coupled to front 718 by scores and a corresponding pair of side support flaps 723*a* and 723*b* coupled to side support panels 722*a* and 722*b* by scores. From its substantially planar configuration, further assembly is needed to configure lower shelf 703 into the usable configuration illustrated in FIGS. 48-51. In particular, lower shelf 703 is positioned with the inner surface facing up. Tabs 719' and 719" on shelf panel 719 are folded in and front 718 is folded up. Side support flaps 723*a* and 723*b* are folded up and the backings on adhesive are removed from the outer surface of side support flaps 723*a* and 723*b*. Side support panels 723*a* and 723*b* and side support flaps 723*a* and 723*b* are folded in. Side support panels 722*a* and 722*b* are aligned with free edge of shelf panel 719 and pressure is applied to secure the adhesive. Bottom 717 is folded down and the entire lower shelf 703 is flipped over so that the outer surface is facing up. Back 720 is back folded at fold 760*a* and side flaps 720' and 720" are folded in.

As illustrated in the substantially planar configuration of FIG. 54, upper shelf 705 includes a shelf panel 761, a back 762 coupled to shelf panel 761 by a score and a top 764 coupled to back 762 by a score and having a top flaps 763*a* and 763*b*. From its substantially planar configuration, further assembly is needed to configure upper shelf 705 into the usable configuration illustrated in FIGS. 48-51. In particular, back 762 is folded up at fold 760*b* and back flaps 762' and 762" and top flaps 764' and 764" are folded back.

As illustrated in the substantially planar configuration of FIG. 56, header 708 includes a front panel 724, a back panel 725 coupled to front panel 724 by a score or fold, a right side flap 726 coupled to front panel 724 by a score or fold, a left side flap 727 coupled to front panel 724 by a score or fold and a pair of downward depending tabs 728 and 729 extending from an edge of front panel 724 that is opposite the score or fold that connects back panel 725 to front panel 724. Right side flap 726 includes an adhesive strip 730 having a backing and left side flap 727 also includes an adhesive strip 731 having a backing. From its substantially planar configuration, further assembly is needed to configure header 708 into the usable configuration illustrated in FIGS. 48-51. In particular, back panel 725 is folded over the interior side of front panel 724. Backings on the adhesive strips 730 and 731 are removed and right side flap 726 and left side flap 727 are folded over the exterior side of back panel 725 and secured with adhesive 730 and 731. Although not illustrated in FIG. 56, a front facing surface of front panel 724 can include indicia.

To assemble display fixture 700, shelf panel 719 of lower shelf 703 is aligned and inserted into front clips 732 and 733 (FIG. 52) and therefore is located between right side panel 710 and left side panel 712 near bottom edge 714 of main body 702. Top 721 is tucked in. In this way, front 718 acts as a toe kick, shelf panel 719 defines the bottom of lower shelf 703 and back 720 defines the back of lower shelf 703. The assembled lower shelf 703 is illustrated in detail in FIG. 50.

Next, shelf panel 761 of upper shelf 705 is aligned and inserted into clips 734 and 736 and therefore is located between right side panel 710 and left side panel 712 of main body 702. Top flaps 763*a* and 763*b* are folded at fold 760*c* and top flaps 763*a* and 763*b* are tucked in. In this way, shelf panel 761 defines a bottom of upper shelf 705, back 762 defines the back of upper shelf 705 and top 764 defines a top ledge of upper shelf 705.

Still further, to finish assembling display fixture 700, cross-bar component 707 is mounted to interior surfaces 716 and 717 of right side panel 710 and left side panel 712 and located above shelves 703 and 705 using clips illustrated in FIG. 52. In addition, the pair of downward depending tabs 728 and 729 of header 708 are inserted into slots located along a top edge 742 of main body 702. More particularly, the slots are located along top edge 742 of center panel 711. Header 708 is pressed down until assembled front panel 724 is flush with top edge 742 of main body 702.

With reference to FIGS. 48-51, fully assembled display fixture 700 includes main body 702 having substantially vertically oriented right side panel 710, center panel 711 and right side panel 712. Further, main body 702 includes front facing edges 744 and 745. Front facing edge 744 defines a free edge of right side panel 710 and front facing edge 745 defines a free edge of left side panel 712. Right side panel 710 and left side panel 712 taper along front facing edges 744 and 745 from bottom edge 714 to top edge 742 of main body 702. In other words, right side panel 710 and left side panel 712 include substantially similar top edge depths 748 (FIGS. 50 and 51) and substantially similar bottom edge depths 750 (FIGS. 50 and 51). Top edge depth 748 is less than bottom edge depth 750. Fully assembled display fixture 700 includes lower and upper shelves 703 and 705. Lower shelf 703 is coupled to main body 702 using clips 732 and 733 located on right side panel 710 and left side panel 712 and also provides a toe kick. Upper shelf 705 is coupled to main body 702 using clips 734 and 736 located on right side panel 710 and left side panel 712. The bottoms of shelves 703 and 705 are defined by shelf panels 719 and 761 and are oriented at an angle 746 relative to bottom edge 714 of main body 702. Angle 746 is an acute angle (i.e., greater than zero degrees and less than 90 degrees) and orients lower shelf 703 and upper shelf 705 so that the front of shelf panels 719 and 761 are located closer to top edge 742 of main body 702 than the back of shelf panels 719 and 761 are to top edge 742. Likewise, the backs of shelf panels 703 and 705 are located closer to bottom edge 714 of main body 702 than the fronts of shelf panels 719 and 761 are to bottom edge 714. This angled orientation of shelves 703 and 705 allow a customer to better see all of the packages located on shelves 703 and 705 for ease of identifying and selecting sizes, such as garment sizes. The backs of shelves 703 and 705 are defined by backs 720 and 762 and are substantially perpendicular to the bottoms of shelves 703 and 705. Mounted to right side panel 710 and left side panel 712 of main body 702 and located above shelves 703 and 705 is cross-bar component 707. As illustrated in FIG. 55, cross-bar component 707 includes a plurality of spaced apart holes 790, 791, 792, and 793 for receiving clothes hanger hooks. As illustrated in FIG. 51, cross-bar component 707 is spaced apart from interior surface 713 of center panel 711 a distance 709 that is less than a length of a shoulder component of an adult-sized clothes hanger. In this way, garments hung from hangers on cross-bar component 707 are oriented at an angle to a customer for display. More specifically, cross-bar component 707 includes four spaced apart holes 790, 791, 792 and 793 that are rectangular in shape, however, cross-bar component 707 can include any number of holes. Each hole receives hooks of a clothes hanger that are supporting various colors of a specific garment size or various sizes of a specific color and style of garment for display.

The front facing surface of front panel 724 of header 708 includes a sign holder 752. Sign holder 752 is a pocket made of, for example, an extruded polymer and is configured to receive a sign or graphic. While display fixture 700 illustrates sign holder 752 being located across only a portion of the front facing surface of front panel 724, sign holder 752 can be large enough to extend across the entire exterior surface of front panel 724. In addition, front edges 782 and 783 of shelves 703 and 705 can include a label holder made of, for example, an extruded polymer and configured to receive at least one price label.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:

a main body including three panels, wherein each panel includes an interior surface and the interior surfaces of two of the panels face each other and the interior surface of one of the panels faces forward;

a lower shelf located between and coupled to the two panels of the main body that face each other, the lower shelf including at least one divider oriented substantially parallel to, spaced apart from and positioned between the two panels of the main body for dividing the lower shelf into bins;

an upper shelf located between the two panels of the main body that face each other and is supported by and coupled to the lower shelf, the upper shelf including at least one divider oriented substantially parallel to, spaced apart from and positioned between the two panels of the main body for dividing the upper shelf into bins; and a planar peg insert having a front surface and a back surface and supporting a plurality of peg hooks that protrude from the front surface of the planar peg insert, the back surface of the planar peg insert being coupled to the interior surface of the panel of the main body that faces forward and the planar peg insert being located above the upper and lower shelves.

2. The display fixture of claim 1, wherein each of the lower shelf and the upper shelf is defined by a top, a bottom and a back.

3. The display fixture of claim 2, wherein the bottom of the lower shelf is oriented at an angle relative to the bottom edge of the main body, the angle being an acute angle.

4. The display fixture of claim 1, wherein each of the lower shelf and the upper shelf is defined by a front, a bottom and a back, each bottom of the lower and upper shelves being oriented substantially parallel with top edges and bottom edges of the three panels of the main body.

5. The display fixture of claim 4, wherein each front of the lower and upper shelves is oriented at an angle relative to the bottom of each of the upper and lower shelves, the angle being greater than 90 degrees.

6. The display fixture of claim 4, wherein each back of the lower and upper shelves is oriented at an angle relative to the bottom of each of the lower and upper shelves, the angle being greater than 90 degrees.

7. The display fixture of claim 1, further comprising a header having a front panel and at least two downward depending tabs, wherein the at least two downward depending tabs are inserted into slots located along a top edge of the panel of the main body that faces forward, wherein a front facing surface of the front panel of the header includes indicia.

8. A display fixture comprising:

a main body including a top edge, a bottom edge, a pair of side panels and at least one center panel, wherein each of the side panels and the center panel include interior surfaces and the interior surfaces of the side panels face each other; and a plurality of shelf trays located between and coupled to the side panels of the main body and including at least one upper shelf tray and at least one lower shelf tray, wherein each of the at least one upper shelf tray and the at least one lower shelf tray are defined by a front wall, a bottom and a back wall and the bottom of each of the at least one upper shelf tray and the at least one lower shelf tray being oriented substantially parallel with the top edge and the bottom edge of the main body; and wherein each front wall of the at least one lower and upper shelf trays extends above the bottom of each of the at least one upper and lower shelf trays and comprises a outer facing surface and an inner facing surface, the inner facing surface of each front wall is oriented at an angle relative to the bottom of each of the at least one upper and lower shelf trays that is greater than 90 degrees and less than 180 degrees.

9. The display fixture of claim 8, further comprising a peg insert supporting a plurality of peg hooks and coupled to the interior surface of the center panel of the main body, the peg insert being located above the at least one upper and lower shelf trays.

10. The display fixture of claim 8, wherein each back wall of the at least one lower and upper shelf trays is oriented at an angle relative to the bottom of each of the lower and upper shelves, the angle being greater than 90 degrees.

11. The display fixture of claim 8, further comprising a header having a front panel and at least two downward depending tabs, wherein the at least two downward depending tabs are inserted into slots located along a top edge of the center panel of the main body, wherein a front facing surface of the front panel of the header includes indicia.

12. The display fixture of claim 8, wherein each front wall of the at least one lower shelf tray is located in closer proximity to front facing edges of the side panels of the main body than each front wall of the at least one upper shelf tray.

13. The display fixture of claim 8, wherein each back wall of the at least one lower shelf tray is located in closer proximity to front facing edges of the side panels of the main body than each back wall of the at least one upper shelf tray.

14. A display fixture comprising:

an upright component including three sections having interior surfaces that are coupled together by two folds, wherein the interior surfaces of two of the sections face each other and the interior surface of one of the sections faces forward, wherein the two sections that face each other have top edges, bottom edges and front facing edges that extend linearly from the top edges to the bottom edges, the bottom edges of the two sections that face each other are greater in length than the top edges of the two sections that face each other so that the linear front edges taper from the bottom edges to the top edges;

a lower shelf positioned between and coupled to the two sections of the upright component that face each other; and an upper shelf located above the lower shelf and positioned between and coupled to the two sections of the upright component that face each other, wherein the upper shelf is supported by and coupled to the lower shelf;

wherein a back wall of the lower shelf is located in closer proximity to the front facing edges of the two sections that face each other of the upright component than a back wall of the upper shelf; and wherein each back wall of the at least one lower and upper shelves are oriented at an angle relative to the bottom edges of the two sections that face each other, the angle being greater than 90 degrees and less than 180 degrees.

15. The display fixture of claim 14, further comprising a peg insert supporting a plurality of peg hooks and coupled to the interior surface of the section of the upright component that faces forward, the peg insert being located above the upper and lower shelves.

16. The display fixture of claim 14, wherein the front wall of the lower shelf is located in closer proximity to front facing edges of the two sections that face each other of the upright component than the front wall of the upper shelf.

17. The display fixture of claim 14, wherein bottoms of the lower and upper shelves are oriented substantially parallel with a top edge and a bottom edge of the upright component.

18. The display fixture of claim 14, wherein a bottom of the lower shelf is oriented at an angle relative to a bottom edge of the upright component, the angle being an acute angle.

19. The display fixture of claim 14, further comprising a cross-bar component coupled to and extending between the two sections of the upright component that face each other and including spaced apart holes for receiving hooks of clothes hangers, the cross-bar component being spaced apart from the interior surface of the section that faces forward by a distance that is less than a length of a shoulder of a clothes hanger.

* * * * *